US005863343A

United States Patent [19]

Campbell

[11] Patent Number: 5,863,343

[45] Date of Patent: Jan. 26, 1999

[54] ULTRASONIC CLEANING METHOD OF CLEANING CHANDELIERS

[76] Inventor: Keith S. Campbell, 87 Larch Row, Wenham, Mass. 01984

[21] Appl. No.: 994,209

[22] Filed: Dec. 19, 1997

Related U.S. Application Data

[63] Continuation of Ser. No. 558,538, Nov. 16, 1995, abandoned, which is a continuation-in-part of Ser. No. 153,294, Nov. 16, 1993, Pat. No. 5,472,005.

[51] Int. Cl.[6] ..... B08B 3/12

[52] U.S. Cl. ..... 134/1; 134/25.4; 134/25.5

[58] Field of Search ..... 134/1, 25.1, 25.4, 134/25.5

[56] References Cited

U.S. PATENT DOCUMENTS

| | | | |
|---|---|---|---|
| 3,392,964 | 7/1968 | Krolik et al. | 134/188 |
| 3,995,584 | 12/1976 | Wendt | 134/1 |
| 4,367,098 | 1/1983 | McCord | 134/25.4 |
| 4,483,718 | 11/1984 | Bross et al. | 134/25.4 |
| 4,836,858 | 6/1989 | Reinhart | 134/1 |
| 5,021,097 | 6/1991 | Konig et al. | 134/25.5 |
| 5,603,773 | 2/1997 | Campbell | 134/1 |

*Primary Examiner*—Jeffrey Snay
*Attorney, Agent, or Firm*—Herbert L. Gatewood

[57] ABSTRACT

Apparatus is provided for the cleaning of the downwardly extending pendants and swags of beads of a chandelier in situ by ultrasonic cavitation. The cleaning apparatus is provided with a top member detachably connected to a bottom member. The bottom member can be of one size and configuration and be interchangeable with top members of various sizes and configurations. Apparatus is also provided for lifting the ultrasonic cleaning apparatus vertically upwardly to locate the cleaning apparatus for the cleaning of certain preselected chandelier pendants or swags, holding the cleaning apparatus in that position while the pendants or swags are being subjected to ultrasonic energy, and then lowering the cleaning apparatus vertically downwardly so that the cleaning apparatus can be repositioned for the ultrasonic cleaning of further preselected pendants and swags. Ultrasonic cleaning apparatus can be provided of compact design and light weight which is hand-holdable for the ultrasonic cleaning of one or more pendants or one or more festoons of beads at one time.

4 Claims, 9 Drawing Sheets

ULTRASONIC CLEANING METHOD OF CLEANING CHANDELIERS

CROSS REFERENCES TO RELATED APPLICATIONS

This application is a continuation of application Ser. No. 08/558,538, filed Nov. 16, 1995, now abandoned, which is a continuation-in-part of application Ser. No. 08/153,294, filed Nov. 16, 1993, now U.S. Pat. No. 5,472,005.

BACKGROUND OF THE INVENTION (1). Field of the Invention

This invention relates, in general, to ultrasonic cleaning apparatus, and more specifically to ultrasonic cleaning apparatus for the cleaning in situ of chandeliers comprising a plurality of downwardly extending pendants, and in some cases, festoons of spaced-apart beads or crystals. In particular, the invention relates to easily portable ultrasonic cleaning apparatus for the cleaning of such chandeliers. Further, the invention relates to portable means for the raising and lowering of ultrasonic cleaning apparatus and for maintaining the apparatus in the raised position whereby ultrasonic cleaning of a chandelier can be accomplished in situ.

(2). Description of the Prior Art

The term ultrasonics (or supersonics) refers to sound vibrations, i.e., variations of density in an elastic media such as air and water, whose frequencies are beyond the auditory limit. Such high-frequency vibrations are produced in various ways known to those skilled in the art, based upon different principles. The ultrasonic cleaning of objects depends upon cavitation, i.e., the rapid formation and violent collapse of minute bubbles or cavities in a cleaning solution or liquid. This action creates a highly effective and unique penetrating action that, in a sense, blasts dirt, grit, and other contaminants from the surface of an object that has been covered with such materials. Ultrasonic cleaning can get into crevices in an object where dirt, etc. lies that other cleaning methods can not readily accomplish, if at all. It can remove contaminants that defy soaking, scrubbing, spraying and other conventional cleaning methods.

Ultrasonic vibrations are used in the cleaning of a wide variety of objects, e.g., jewelry, castings, automobile radiators, biofouled heat exchangers, etc. Illustrative of patents disclosing such cleaning applications are U.S. Pat. Nos. 2,987,068; 3,295,596; 3,640,295; 4,375,991; and 4,372,787.

In U.S. Pat. No. 2,987,068, which issued to N. G. Branson on Jun. 6, 1961, there is disclosed ultrasonic cleaning apparatus comprising a tank in which a plurality of ultrasonic transducer elements are located. The transducer elements are so located, according to the patentee, that objects to be cleaned supported in the cleaning liquid, i.e., water, are subjected to direct sonic energy as well as that reflected back from the surface of the cleaning liquid. The transducer elements are hermetically sealed stainless steel metal cans of generally rectangular shape within which are provided piezoelectric elements such as those formed of barium titanates, these elements being adhered to the upper surfaces of the cans so that their vibrations, when subjected to high frequency energy, are transmitted into the cleaning liquid.

U.S. Pat. No. 3,295,596 discloses ultrasonic means for the cleaning of the tubes in a heat exchanger while the heat exchanger is still on line. The ultrasonic cleaning means comprises, in general, an ultrasonic transducer in combination with a liquid coupling means, such cleaning means being strapped in combination with the outside surface of the heat exchanger shell. The ultrasonic energy from the transducers is transmitted through the liquid in the liquid coupling means through the shell and the liquid between the shell and the heat exchanger tubes.

In U.S. Pat. No. 3,640,295, there is disclosed apparatus for the ultrasonic cleaning of surgical instruments. This apparatus involves, in general, a cabinet in which is provided a sink for the holding of cleaning liquid. Ultrasonic transducers are located on the walls of the sink and on the bottom surface. The instruments to be cleaned are placed in a case having perforations provided therein, and the case is placed in a cradle located in the sink. The cradle oscillates during the cleaning process.

U.S. Pat. No. 4,375,991 discloses ultrasonic cleaning apparatus for the cleaning in situ of biofouling from heat exchangers located in ocean thermal energy conversion plants. The ultrasonic cleaning apparatus in this case is, in general, a support plate in which a planar array of transducers is provided. The support plate is raised and lowered between adjacent rows of heat exchanger tubes and maintained in position while the cleaning is accomplished by a positioning means. The positioning means comprises cables that are attached to the support plate at one end and to winches at the other end.

U.S. Pat. No. 4,372,787 discloses ultrasonic cleaning apparatus for the cleaning of radiators. The cleaning apparatus comprises, in general, a tank in which cleaning liquid is provided. A support means is provided in the tank for holding the radiator during the cleaning cycle.

Over the past several years, it has become somewhat customary to provide chandeliers in restaurants, motels, bars and other public places which comprise a plurality of downwardly extending, spaced-apart, elongated crystals or pendants. The pendants are, in general, provided in a rectangular-shaped pattern or array of a plurality of rows and columns of pendants, the rows being provided parallel to one another, as are the columns. Thus, the location of a particular pendant in such a chandelier is identified by the particular row and column in which it is located, e.g., Row 3, Column 3.

A chandelier such as earlier disclosed may comprise, in at least some cases, a number of tiers of pendants, e.g., an inner or centrally located tier, a middle tier that surrounds the inner tier, and an outer tier of parallel rows and columns of pendants in surrounding association with both the inner and middle tier. The middle and inner tiers also comprise a plurality of parallel rows and columns of pendants. The bottom ends of the pendants in the multiple rows and columns of pendants in the tiered chandeliers terminate in different horizontal planes parallel to one another. The pendants in such a chandelier are, in general, of different lengths, e.g., the outer column or rows of pendants in the outer tier are the longest, while those located in the inner columns and rows of the outer tier are of a shorter length. The top ends of the pendants located in the inner rows and columns are located such that the top ends of such pendants lie in a horizontal plane located above that in which the bottom ends of the pendants in the outer rows terminate. Thus, the top ends of those pendants located in the inner rows are hidden from view, allowing shorter length pendants to be used in the construction or make-up of the chandelier, rather than having to use pendants all of the same length, i.e., the longer length pendants located in the outermost rows and column. In a similar manner, the tops of the pendants making up those tiers located more inwardly can lie in a horizontal plane above that in which the bottom of the pendants in the next adjacent outer tier lie.

The elongated pendants making up such a chandelier as above-described are, in general, suspended vertically downwardly from the ceiling of a room or other area in which the chandelier is located. The ceiling or other horizontal surface from which the pendants are suspended by their top ends is generally provided with a horizontally disposed planar mirror, i.e., a reflective surface, which may be of glass or metal. Located somewhat below the reflective surface are a plurality of spaced-apart light fixtures in which are located light bulbs of suitable size.

The pendants are, in general, of conventional lead containing glass. Thus, the pendants, particularly when provided with multiple flat surfaces along the length thereof, are reflective to light. The pendants, in general, are of triangular cross-section with elongated flat surfaces; however, in some cases the pendants are provided with inwardly curved surfaces. The pendants are sometimes of other configuration, even of cut glass. Thus, the pendants reflect light from the light bulbs and that reflected from the mirror surface, providing an attractive chandelier, and enhancement of the appearance of the surroundings in which the chandelier is located.

The pendants in the outer rows of pendants in such a chandelier as just described, e.g., the outer row of pendants in the outer tier are, in general, attached by their top ends to the ceiling by conventional "S" hooks, so that the top of each pendant in the outer row is located about ½ inch or so down from the ceiling. The pendants located in the inner columns and rows of pendants are suspended from the ceiling, in general, by a conventional flexible chain comprising metal beads, like the conventional key chain, the chain being attached at its top end to the ceiling and at the bottom end to the top end of a pendant. Thus, a conventional eye fastener or hook may be provided in the top end of a pendant, an "S" hook being connected to that eye fastener and to another eye fastener provided in the ceiling.

In some cases, the top ends of the pendants are not connected directly to the ceiling of a room. Instead, a horizontally disposed planar member will be mounted to the ceiling so as to be parallel thereto. The size of such a member will depend upon the size chandelier desired, i.e., the number of rows and columns of pendants. The mirror or reflective surface will then be mounted to this member. The tops of the elongated pendants are connected to that horizontally disposed member, as if it were the ceiling.

At other times, a stepped platform or one arranged in tiers will be provided, that platform being directly attached to the ceiling of a room and providing a plurality of horizontally disposed planar members to which the tops of the pendants are attached. Thus, when "ceiling" is used herein, it will be appreciated that the top of the pendants are attached to a horizontally disposed surface and extend vertically downwardly therefrom but that such a member is not necessarily the ceiling. It may be a planar backing member attached to the ceiling or a horizontally disposed member of a stepped platform, as above-described.

In some cases also the chandelier may comprise merely columns and rows of elongated pendants or crystals all of the same length. Thus, in such a chandelier, the bottom ends of the pendants all terminate in the same horizontal plane. Some chandeliers may also comprise circular rows of vertically suspended pendants, these pendants being spaced apart from one another in a plurality of concentric circles. The concentric rows of pendants may sometimes be arranged in tiers. With such chandeliers, it is common to find one or more festoons of beads or crystals as the outer circle of the chandelier.

As can be readily expected, the surfaces of the glass pendants and the beads of the festoons, over time, become covered with dust and other contaminants from the environment. Some of the pendants and beads will become more dirty than others due to the particular location of the chandelier. For example, a chandelier located in the lobby of a motel at the entry way may become more dirt laden, and in a shorter period of time, than one located in a function room. As the pendant or bead surfaces become covered with airborne dust, etc., the reflectiveness of the chandelier pendants and festoons is continuously reduced. And, as a result of this reduced reflectiveness, the attractiveness of the chandelier is greatly diminished. This is a real problem where the chandeliers are more readily seen by motel or hotel visitors, e.g., around an entryway to the motel, at the registration desk, etc., where good impressions are most important.

Accordingly, it becomes necessary eventually that the chandelier pendants and festoons be cleaned, to regain the initial sparkle and reflectiveness thereof, and to restore the overall attractiveness of the chandelier. The point in time, in the past, at which the cleaning of any particular chandelier has taken place has depended upon a number of factors including just how unattractive the chandelier has become and how much the motel management will tolerate in loss of attractiveness. The cleaning of chandeliers prior to my invention as disclosed herein, moreover, has involved considerable cost to the motel or hotel operator.

The cleaning of chandeliers having downwardly extending pendants heretofore has involved a variety of methods. One such method known of, for the cleaning of the elongated pendants of a chandelier, has involved the spraying of the pendants in place with an acid containing water solution. Thus, a person performing the cleaning of such a chandelier, in general, uses a step ladder of suitable size to put himself in position to perform the cleaning operation. This is of great disadvantage as no more than a few pendants can be sprayed and cleaned at any one time. Thus, the ladder must be moved often to complete the cleaning of even a smaller sized chandelier. The time spent in moving the ladder from time-to-time adds substantial time to the time actually spent in the cleaning of the pendants of a chandelier. Further time is spent, as is a great deal of effort, in the necessary up and down movements on the ladder by the person performing the cleaning. Of further disadvantage also, and believed to be of even more critical concern than the movement of the ladder, is the use of the acid containing water solution. This is a ruinous practice not only to the glass pendants but also to the mirror and light fixtures associated therewith, as well as any metal elements in the chandelier structure. The acid cleaning solution gets into the light sockets and not only causes burnout but also causes corrosion of the elements in the sockets. Thus, from time-to-time, or eventually, these various elements making up the chandelier or that are associated with the pendants need to be replaced. In some cases, even more often, the light fixtures need replacement. These problems, of course, involves additional operating costs.

Another method for the cleaning of chandeliers having downwardly extending pendants has required a number of laborious and time-consuming operations. First, the pendants are each taken down from the ceiling so that they can be cleaned. The numerous pendants to be cleaned, e.g., in some cases as many as 6–10 thousand, are all then immersed in a cleaning solution provided in an appropriate tank or container therefor and allowed to remain therein for a suitable time to remove the contaminants. Afterwards, the pendants may be subjected to a rinse bath. Following cleaning and rinsing, the pendants are then allowed to dry off some after which the pendants are individually reattached to the ceiling in the appropriate locations to reconstruct the chandelier, i.e., rehanging each of the pendants on a conventional "S" hook or the like so as to extend vertically downwardly from the ceiling.

Although this manner of cleaning the pendants of a chandelier may, in certain respects, be better than the spray method, it nevertheless is still attendant with a number of problems and disadvantages. One problem, in particular, involves the "S" hook fastening members for the pendants. When a chandelier is first constructed, those constructing the chandeliers see to it that the ends of the "S" hook fastener are closed. This action, of course, better ensures that the pendants will not be accidentally disconnected from the ceiling. In the event a pendant did fall from the chandelier serious injury could be caused to a person that might be hit by a falling pendant, sometimes 30" or so in length. Nevertheless, as a result of the "S" hook fasteners being closed at their ends on installation, it is necessary for one taking a pendant down to be cleaned to open the fastener. Thus, an end of the "S" hook fastener is bent to open it, so that the pendant can be removed from the fastener and taken down for cleaning. With the closeness of the spacing of the pendants from one another, however, this can be achieved only with some difficulty. This closeness presents even more difficulty on rehanging the pendants. As a result, the "S" hook fastener end is ordinarily not closed but, instead, is left open, or at least partially open. Another reason that the "S" hook is left open is the fact that closing of the "S" hook fastener is time consuming. The result of not closing the "S" hook, however, whether intentional or by oversight, is believed to present a potentially hazardous condition. This is particularly the case, it is believed, where a chandelier may be installed adjacent an outer door, e.g. in a motel lobby, and the pendants are subject to occasional gusts of air or wind. The same is true where the pendants may be subject to some vibration, though slight, for example, where a chandelier might be located adjacent a bank of elevators. The extent of the potential for the dislodgment of a pendant from its "S" hook fastener depends, of course, largely on how much the end of the "S" hook was opened to be able to take down a particular pendant. This, as will be readily appreciated, depends upon who took the pendant down and who put it back up. One person may be inclined to open or close the "S" hook fastener more than another, or to leave the fastener open. Where a chandelier is made up of not only pendants, but also festoons, the taking down of the festoons of beads for cleaning often causes the thin chains or wires between next adjacent beads to become stretched. This stretching results in the nonuniform spacing between the beads of a festoon and effects the reflectiveness and appearance of the chandelier. In other cases, the beads themselves are broken. In any event, the cleaning of the wires between the beads of a festoon is, in general, not sufficiently done to restore these wires or chains to there original appearance.

Of concern also in this manner of cleaning is the fact that the pendants are ordinarily merely placed in the cleaning tank, one on top of the other. The result is that those parts of the pendants that contact one another may often be cleaned to a somewhat lesser degree than are those parts not in contact. Thus, when the pendants are rehung, certain of the pendants may be more or less reflective than others resulting in a less than optimum appearance, or restoration to their initial state of reflectiveness, even though considerable expense and effort has been expended to obtain such a result.

Heretofore, the pendants of a chandelier, as above described, have also been cleaned by ultrasonic means. This procedure has involved, in general, the taking down of the pendants individually as earlier disclosed and immersing them in a cleaning solution contained in a tank or container provided for the purpose and in which ultrasonic transducers have been provided. The cleaned pendants are then rinsed, allowed to dry, and then rehung from the ceiling as earlier described. Thus, although the chandelier pendants have heretofore been cleaned by ultrasonic means, such is still attendant with the same problems and disadvantages as cleaning without ultrasonic means, in particular, the time consuming and costly job of taking down and rehanging the pendants. Further, there is the problem of potential for accident, and pendant breakage.

Whether the cleaning of the pendants of chandeliers heretofore has been accomplished by ultrasonic or other means, it will be readily appreciated that any such a procedure has been a somewhat time consuming task and quite labor intensive. And because of this, the cleaning of the chandeliers as disclosed heretofore has been somewhat expensive. To clean a chandelier, as earlier disclosed, e.g., one measuring 4'×8', prior to my invention, has taken 1½ days with two people. The larger part of that time, however, is spent in the labor of taking down the individual pendants and then rehanging them again, after such have been cleaned. Once taken down, the pendants of a chandelier can be cleaned ultrasonically in only a few minutes, depending largely on how soiled the pendants may be.

Due to the above considerations, motels and other institutions where such chandeliers as earlier disclosed are installed often have the chandeliers cleaned less frequently than is really needed or actually desirable. This is particularly the case where a number of such chandeliers are installed at a particular institution. The more often the chandeliers are cleaned, the greater the increase in operating costs. In some cases, chandeliers comprising downwardly extending pendants have not been cleaned since their installation.

With the ultrasonic cleaning of chandeliers of my invention, as disclosed in application Ser. No. 08/153,294, now U.S. Pat. No. 5,472,005 a great advance was made in the cleaning of chandeliers having downwardly extending pendants and, in some cases, festoons of beads. This results from the fact that the pendants and festoons of a chandelier can be cleaned in situ. Thus, the time and effort of taking down the pendants for cleaning and then rehanging them is no longer expended.

Although the ultrasonic cleaning apparatus of my invention allows the cleaning of the pendants of a chandelier in situ and such apparatus provides numerous advantage over the cleaning of chandeliers heretofore, the ultrasonic cleaning apparatus disclosed is still attendant with certain disadvantages. In particular, there is need for improved means for the raising and lowering of the ultrasonic cleaning apparatus disclosed in the before-mentioned patent application. Moreover, there is the need for more portable ultrasonic cleaning apparatus for the cleaning of the pendants and festoons of a chandelier in situ.

SUMMARY OF THE INVENTION

The present invention overcomes the problems associated with the cleaning of the pendants of chandeliers known heretofore and fulfills the need for efficiently and effectively cleaning the outer surfaces of the chandelier pendants.

Therefore, a primary object of the invention is to provide ultrasonic cleaning apparatus for the cleaning in situ of the pendants and festoons of chandeliers not having the problems above-mentioned.

It is another object of the invention to provide ultrasonic cleaning apparatus for the ultrasonic cleaning of the pendants and festoons of a chandeliers in situ, such apparatus being capable of being hand held during use.

Still an object of the invention is to provide fully portable and hand-holdable apparatus for the ultrasonic cleaning in situ of chandeliers comprising a plurality of downwardly extending pendants and festoons of beads wherein a single pendant or a festoon of beads can be cleaned at one time.

A further object of the invention is to provide ultrasonic cleaning apparatus for the cleaning in situ of downwardly extending elongated pendants and festoons of beads of a chandelier that is relatively simple in design and construction.

A still further object of the invention is to provide apparatus for the ultrasonic cleaning of a plurality of downwardly extending pendants of a chandelier in situ, that is relatively inexpensive to manufacture, rugged in construction, easy to use, and efficient in operation.

A still further object of the invention is to provide ultrasonic cleaning apparatus that is not only small and compact but also of light weight;

A further object of the invention is to provide apparatus that is ideally suited for the lifting of ultrasonic cleaning apparatus vertically upwardly and downwardly so that the pendants of the chandelier can be cleaned in situ.

An even further object of the invention is to provide apparatus and a method for the cleaning of chandeliers comprising a plurality of downwardly extending pendants in situ whereby the costs of such a cleaning operation is somewhat less expensive in overall costs than such a cleaning operation prior to this invention.

An even still further object of the invention is to provide apparatus for and method of ultrasonic cleaning of chandeliers comprising downwardly extending pendants from the ceiling of a room that is more efficient and less labor intensive, allowing such chandeliers to be cleaned more often than now done, so as to maintain them in the most attractive condition and appearance.

These objects, as well as further objects and advantages of the present invention, will become more readily apparent, it is believed, after reading the ensuing description of a non-limiting illustrative embodiment of the invention while referring to the accompanying drawings.

BRIEF DESCRIPTION OF THE DRAWINGS

In order that the present invention may be more fully understood it will now be described, by way of example, with reference to the accompanying drawings, in which.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the invention may be varied in specific detail from that illustrated and described herein while still achieving the desirable characteristics and features of the invention. Accordingly, the description which follows is intended to be understood as a broad enabling disclosure directed to persons skilled in the applicable arts, and is not to be understood as being restrictive.

Figure 1:
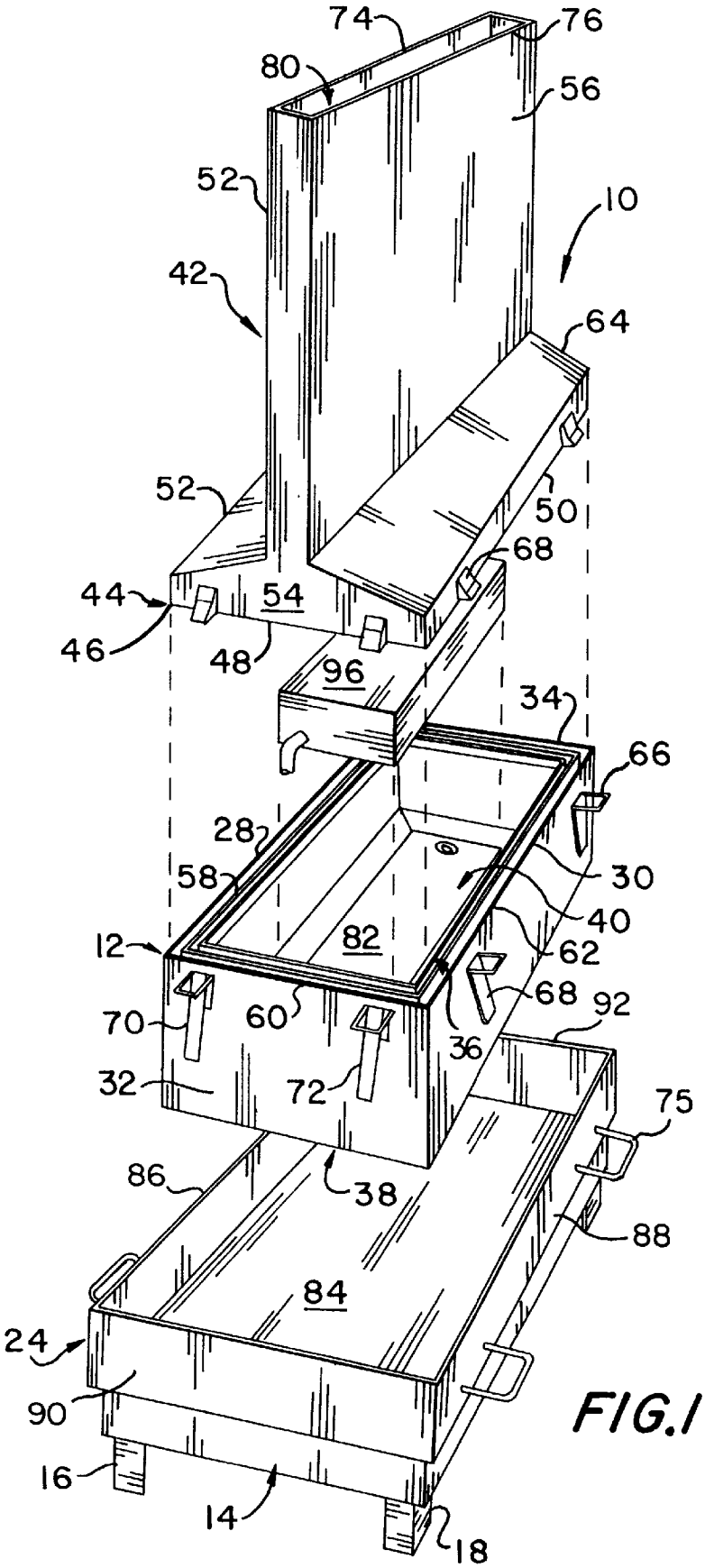
FIG. 1 is an exploded view in perspective showing one embodiment of ultrasonic cleaning apparatus according to the invention, for the cleaning in situ of the elongated, downwardly extending pendants of a chandelier.

Turning now to FIG. 1 of the drawings, there is illustrated therein an ultrasonic cleaning apparatus 10 according to one aspect of my invention. The cleaning apparatus 10 comprises an elongated base or bottom member 12 supported by a platform 14 having downwardly extending legs 16,18,20, and 22, the leg 20 being shown only in FIG. 4 of the drawings.

As shown in FIG. 1, a jacket 24 surrounds the base member 12 at its bottom end and is spaced apart therefrom equidistantly on all sides providing an overflow channel 26 (FIG. 2), the purpose for which will later be fully disclosed.

The base member 12 comprises vertically upright, spaced-apart side walls 28,30 in parallel disposition to one another and vertically upright, spaced-apart, parallel end walls 32,34 intersecting therewith and in perpendicular disposition to the side walls. Thus, there is provided a bottom or base member 12 of rectangular shape having an open top end 36, and a bottom end 38 defining an internal cavity 40. The bottom end can be open or not, as desired, as will be better appreciated hereinafter.

Detachably connected to the base member 12 at its top end 36 there is provided a top member or cap 42 of a predetermined configuration, as shown in FIG. 1. The bottom end 44 of the top member 42 is of the same rectangular configuration as that of the base member 12. The bottom edges 46, 48, and 50 of the side and end walls 52, 54, and 56, respectively, of the top member are located in flat-bottomed U-shaped members 58, 60, and 62 fixedly secured in conventional manner at the top edges of the base member. The bottom edge opposite from bottom edge 48 of the top member is not shown in the drawing; however, it will be appreciated that such is at the bottom of end wall 64. The U-shaped members can have a curved bottom; however, this is somewhat less desired, due to the flat shape of the bottom edges of the top member.

The U-shaped members can be provided on the top edges of the bottom member 12, and such is preferred; however, such can, instead, be provided on the inner surfaces of the side and end walls of the bottom member. Thus, a U-shaped member or flange will be provided for intrusion of the respective bottom edges of the top member. In this latter case, the bottom end of the top member will be of slightly lesser dimensions than the bottom member to allow for the bottom edges to fit into the U-shaped channel provided. The important consideration here is that, when the top and bottom members are secured together, a liquid tight seal is provided between the top and bottom members at their respective top and bottom ends. Such can readily be constructed, it is believed, by those skilled in the art. Nevertheless, the U-shaped members or channel being provided on the top edges of the base member is preferred as such will allow somewhat easier construction of the locking members, later described. Most importantly, however, this provides better structural support of the top member.

Located on the side and end walls 30, 56 and 32, 54, respectively, of the bottom and top members are conventional clamping or fastening means designated generally by reference numerals 66, 68 and 70, 72. Like fastening means, not shown in the drawings, will be provided on the opposing side and end walls of the top and bottom members. Various fastening means may be found suitable for the intended purpose; however, I have found that the two part fastening means such as commonly provided on foot lockers and trunks are quite satisfactory. These fastening means allow the top and bottom members to be drawn into tight sealing engagement with one another. As earlier disclosed, however, various conventional fastening means may be found suitable for the intended purpose. The main thing is that a fastening means be provided on each of the top and bottom members at their respective bottom and top ends and in direct opposition to one another so that when the bottom edges of the top member fit into the U-shaped member or flange of the bottom member in operative engagement, and the fastening means is operated to connect the two members together, the top and bottom members will be brought into a tight, sealing engagement with one another. A suitable gasket member will need be provided in the U-shaped member or flange, according to usual techniques.

The fastening means are provided on the bottom and top members in predetermined spaced-apart locations, as shown in the drawings, so as to provide for good sealing engagement along the entire lengths of the mating edges. Although, only two fastening means are shown to be provided on each of the side and end walls, it will be appreciated that a larger number or different spacing between next adjacent fastening means can be provided, if desired or needed, to provide the optimum sealing engagement. This will depend to some extent upon the length and width of the ultrasonic cleaning apparatus, i.e., the dimensions of the top and base member.

As shown in FIG. 1, the side walls 52, 56 of the top member are spaced-apart from one another at their bottom ends and in parallel relationship for a distance vertically upwardly. Then, the side walls incline inwardly toward one another at equal angles and for the same distance. The side walls 52, 56 then again become parallel and rise vertically upwardly terminating in the spaced-apart top edges 74, 76. The width of the top member 42, i.e., the distance horizontally and perpendicularly, between the parallel side walls at the top edges can vary somewhat, as will be later more fully appreciated. In general, this will depend upon the width of the pendants that are desired to be cleaned and the number of rows or columns of pendants to be cleaned at one time, as well as the spacing between the rows and columns of pendants.

The length of the pendants, i.e., the distance from the top to the bottom end of a pendant in any particular row or column will also influence the particular configuration and dimensions, in particular the most optimum depth of the top member. Thus, the top member, when taken with the depth of the base member in consideration, will need be deep enough to accommodate the length of the longest pendants in a particular chandelier to be cleaned. Thus, if the length of the top member, i.e., the distance from the top end to the bottom end, is designed for the longest pendant anticipated to be cleaned, it will be found suitable for the cleaning of any pendants of a shorter length. Nevertheless, in some cases, it may be desirable to provide top members of different lengths, these being interchangeable, one for the longer length pendants, and one for the shorter pendants, in a chandelier.

Thus, an important feature of my invention is to provide ultrasonic cleaning apparatus for the cleaning of the pendants of a chandelier in situ wherein top members of a plurality of different sizes and configuration are provided. Accordingly, the invention, as disclosed heretofore, provides top members that are interchangeable with one another and that can be readily attached to, or detached from, a base member while maintaining the base member of one size and configuration for various cleaning applications. Such a feature will provide more efficient use of the ultrasonic cleaning apparatus of the invention and accommodate the cleaning of pendants of different lengths.

Figure 2:
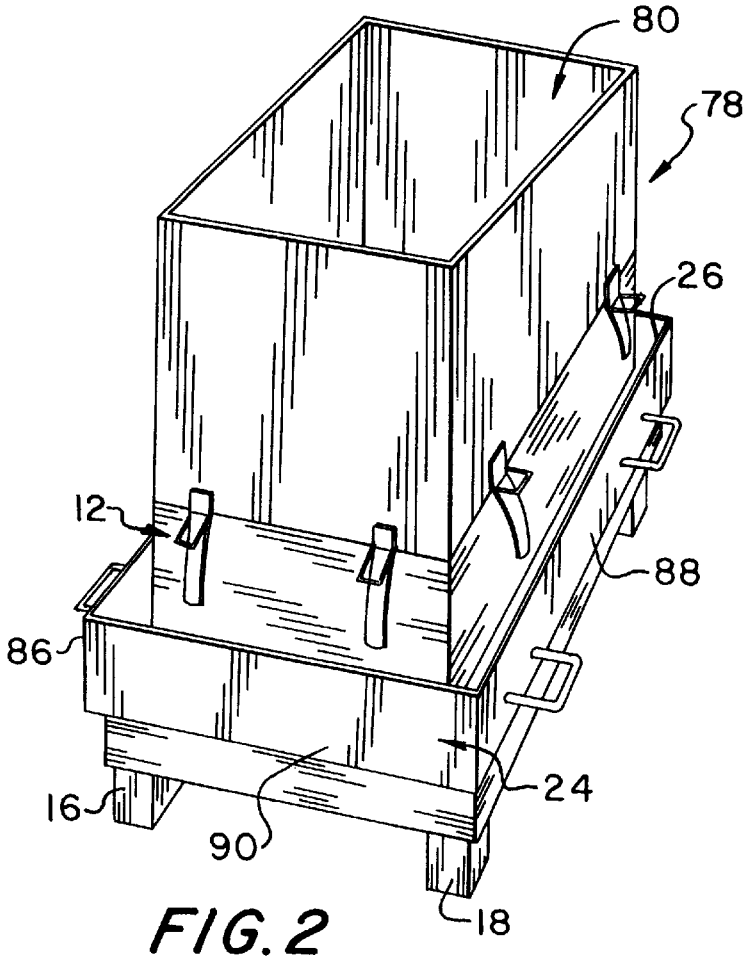
FIG. 2 is a perspective view showing apparatus of the invent-ion such as shown in FIG. 1 but provided with a different top member or cap according to a further feature of the invention.

Accordingly, there is shown in FIG. 2 of the drawing a further embodiment of a top member in accordance with the invention, referred to generally by reference numeral 78. This top member, like top member 42, is defined by open top and bottom ends, the bottom end being detachably connected to the base member 12 of the cleaning apparatus 10, as before-disclosed. As will be appreciated from the drawings, the top and bottom ends of the top member 78 are of equal dimensions. The cavity 80 defined by the parallel side and end walls of the top member communicate with the cavity 40 of the base member, the same as does the cavity provided in top member 42. The depth of the top member, i.e., the distance from the top end to the bottom end thereof, can vary somewhat depending upon the particular application, e.g., the length of the pendants in the chandelier to be cleaned. Thus, and this is of important concern for the most efficient practice of the cleaning apparatus disclosed heretofore. When the apparatus is being used to clean pendants located more inwardly in the chandelier, these being generally of shorter length, the depth of the top member only need be such as to allow for full immersion of these lesser length pendants. That being the case, a top member used for cleaning the longer, outwardly located pendants in a chandelier can be removed and a shorter top member, more suitable for cleaning the shorter pendants, can be substituted therefor. It will be noticed also that the width of the top end of the top member in the cleaning apparatus shown in FIG. 2, compared to that shown in FIG. 1, is considerably greater. This will allow for the cleaning of a plurality of columns or rows of pendants at one time in a chandelier, where the cleaning apparatus shown in FIG. 1 allows only for the cleaning of a plurality of pendants at one time located in a particular row or column.

The bottom end 38 of the open-topped base member 12, as shown in FIG. 1, is provided with a bottom closure 82. This bottom closure provides, along with the side and end walls of the base member, a liquid tight cavity 40. The bottom member and side and end walls can be welded according to conventional techniques to provide such an integral base member. Nevertheless, if desired, the bottom end 38 of the base member can be open, the bottom edges of the base member side and end walls being fixedly attached, instead, to the horizontally disposed planar bottom surface 84 of the overflow jacket 24. If such is the construction, it will be appreciated that a liquid-tight seal must exist between the bottom end 38 of the base member and the bottom surface 84. This can readily be accomplished by known techniques. The jacket 24 is further defined by vertically upright, spaced-apart, parallel side members 86, 88 which intersect with vertically upright spaced-apart parallel end members 90, 92. As shown in the drawings, e.g., FIG. 3, the jacket side and end members are spaced apart from the side and end walls of the base member 12 and are provided in parallel disposition therewith. Thus, there is provided the moat or overflow channel 26, earlier mentioned, which surrounds the centrally disposed base member 12 at its bottom end, the purpose for which will be soon made clear. The bottom surface of closure 82 of the base member can be fixedly attached to the top surface of the bottom member 84 of the overflow jacket 24 by various conventional techniques, e.g., by welding. As earlier disclosed, the bottom member 84 for the overflow jacket 24 can, in some cases, if desired, serve both purposes, i.e., provide a closed bottom for the base member and a bottom member for the overflow jacket. One advantage of a dual purpose for bottom member 84 is that the overall cost of the cleaning apparatus can be somewhat reduced, as well as the weight thereof.

Optionally provided on the outside surface of the side members 86, 88 of the jacket 24 are handles denoted generally by reference numeral 75, the purpose for which will, it is believed, be obvious. Handles are provided in opposed locations on the opposite side members. The handles are spaced apart so that the base member 12 of the cleaning apparatus can best be carried and handled, as needed, in the most efficient and optimum manner. Thus, the apparatus can be carried from a transport member to the use site and then lifted by hand onto a staging located below the chandelier to be cleaned. Handles can be additionally, or instead, provided on the end members of the jacket 24, if desired. In some cases, it may be found that handles located only on the end members will provide more satisfactory handling. The handles provided should take into consideration the overall combined weight of the base member 12, overflow jacket 24, and support platform 14, later more fully described, as these components are generally fixedly secured together, to provide ultrasonic cleaning apparatus of unitary construction. The weight of the top member should also, of course, be considered, to provide means for handling the entire apparatus, if need be, entirely by hand.

Figure 4:
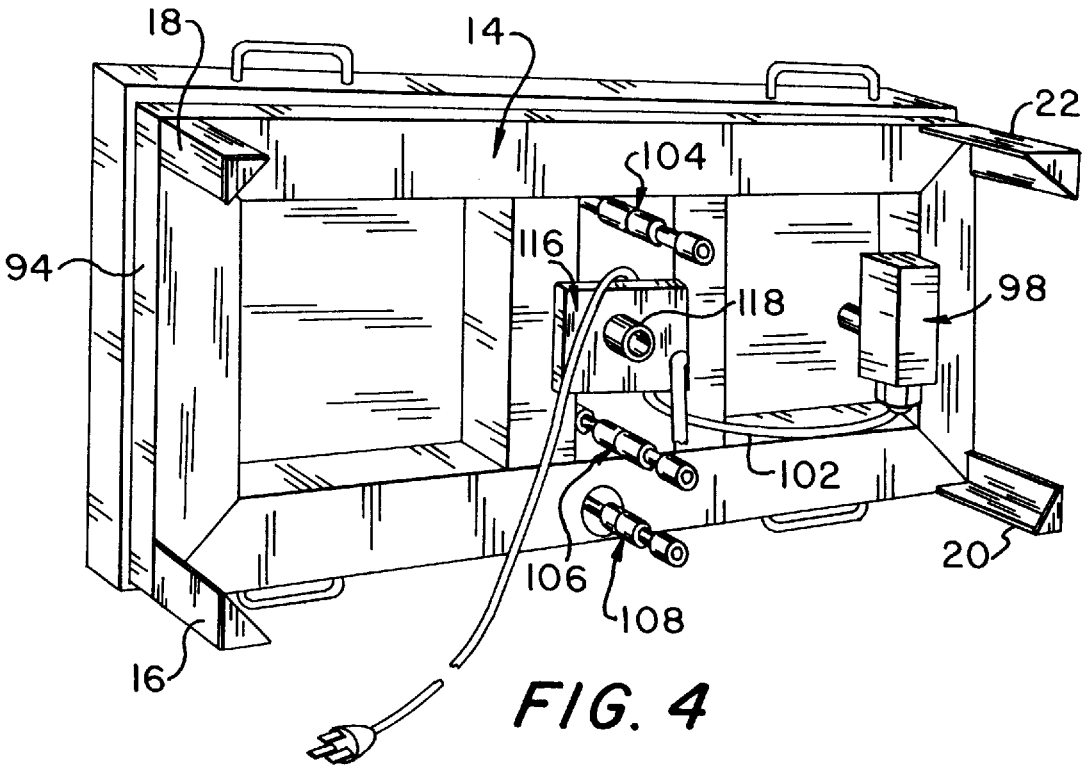
FIG. 4 is a bottom view in perspective showing the bottom of the support member for the ultrasonic cleaning apparatus shown in FIG. 1 and showing a bearing plate for aid in vertically lifting the apparatus according to one aspect of the invention, the location of the junction box for the transducer, and the water inlet and outlet and overflow outlet.

As will be appreciated from the drawings, the base member 12 and surrounding overflow jacket 24 are fixedly connected to the top horizontally disposed surface 94 (FIG. 4) of the support platform 14 by conventional means such as spot welding. The support platform 14, as best seen in FIG. 4, is of a skeletal structure. This will allow for good support of the base and top members, as well as the surrounding jacket 24; however, other configurations will also be found satisfactory, as will be readily appreciated by those skilled in the art. The skeletal structure is somewhat preferred, however, as such allows for less cost and weight.

Figure 3:
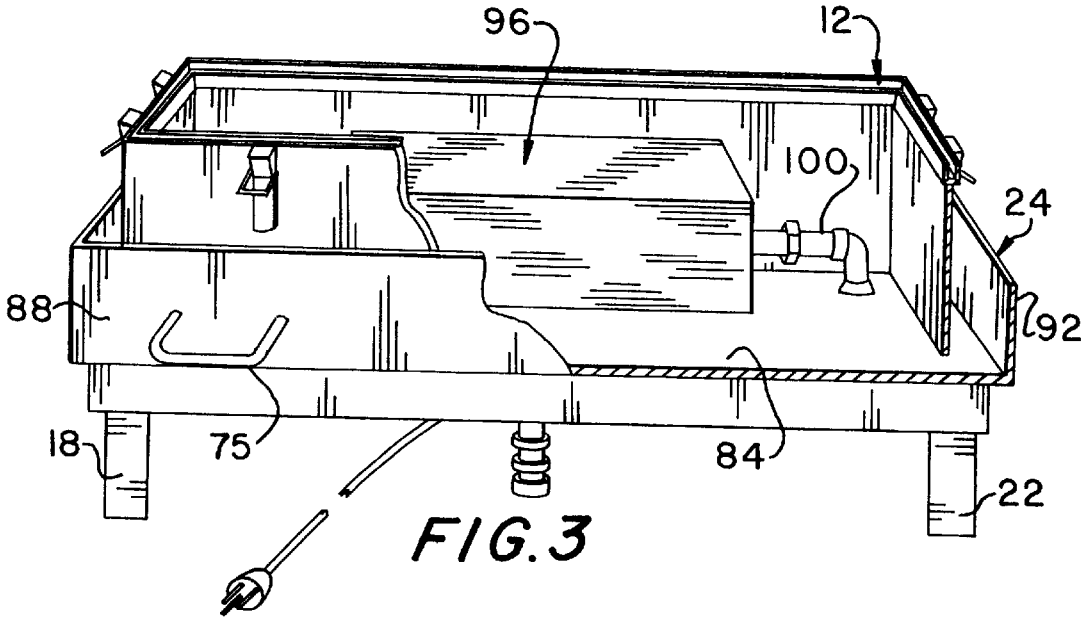
FIG. 3 is a side view in elevation with the top member re-moved and showing a partial cutaway of the base member, to better illustrate and show the location of the ultrasonic transducer in the base member of the ultrasonic cleaning apparatus.

Turning now to FIG. 3 of the drawing, it will be seen that the ultrasonic cleaning apparatus 10 of the invention further comprises an immersible ultrasonic transducer 96. Various of such transducers that are commercially available may be found suitable for use in the cleaning apparatus of the invention. A major consideration, of course, is that a transducer be selected that is immersible in the cleaning liquid to be used. A further and, of course, critical requirement is that the transducer used in the invention be capable of providing the desired cavitation relative to the amount of cleaning liquid contained in the cleaning apparatus. This will naturally depend, in general, upon the size of the cavities 40 and 80 provided in the base and top members.

An ultrasonic transducer that will be found suitable for use in the ultrasonic cleaning apparatus 10, according to this aspect of the invention, is available commercially from Branson Ultrasonics Corporation, Danbury, Conn. under the trade designation Model AF-618-12. This ultrasonic transducer is, of course, immersible. It operates at a frequency of 40 kHz with an output of at least about 360 watts. The transducer used comprises 12 piezoelectric elements comprising lead zirconate titanate ceramic discs in a sandwich-type construction. A rule of thumb provided by the manufacturer is that such a transducer element be provided for each gallon of cleaning liquid contained in the ultrasonic cleaning apparatus. Nevertheless, I have advantageously found that the transducer used in the cleaning apparatus 10 performs quite satisfactorily even though the apparatus may contain as much as 25–30 gallons of cleaning liquid, e.g. water.

Referring to FIG. 4 of the drawing, it will be seen that the junction box 98 provided with the transducer is attached to the bottom of the support platform 14. From the top of the junction box 98 there is provided a conventional conduit 100 (FIG. 3) which passes through the bottom member 84 into the base member 12, being connected in usual manner at its distal end to the ultrasonic transducer. This conduit houses and provides protection to the power cable connecting the junction box to the transducer elements. The cable 102 is connected at its one end to the junction box 98 and at its other end to an ultrasonic generator (not shown). The generator is provided with a conventional three-prong plug for connection to the usual electrical wall socket or the like.

From the bottom of the support platform 14 there is provided, as seen in FIG. 4, a fill pipe 104 which is connected at its top end (not shown) to base member 12 for the filling of the cavities provided by the base and top members when, and as, desired with cleaning liquid. The bottom or free end of the fill pipe can be connected by means of a suitable hose or conduit with a source of cleaning liquid. Further, there are provided discharge pipes 106 and 108, respectively, these being fixedly provided, respectively, in the bottom or end members of the base member and overflow jacket. The drain pipes 106, 108 can be connected to suitable conduits for discharge of any spent cleaning liquid or cleaning liquid that may have overflowed from the top end of the top member into the overflow jacket. The overflow can be discharged either intermittently or continuously, as desired.

It will be appreciated that suitable valves can be provided in the inlet and outlet pipes, as above-disclosed. In some cases, however, it may be more desirable to just provide the free ends of the inlet and outlet pipes with appropriate threads or threaded connectors for attachment to suitable conduits which, in turn, may be connected to a valve at the cleaning liquid source or to waste. These threaded connectors can be, if desired, like those provided on a common garden hose. The connectors can then, as usual, be connected to a suitable length of hose which, in turn, is connected to the discharge valve on a cleaning liquid source and to a discharge source, respectively. Thus, in this case, the cleaning apparatus can, if desired, be filled manually with the cleaning liquid. Conventional end caps may be provided, if desired, on the threaded connectors connected to the outlet and inlet pipes extending from the bottom of the overflow jacket and base member 12.

The optimum configuration of the ultrasonic transducer 96 and its location in the base member 12 will depend to some extent upon the dimensions and configuration of the base member, i.e., whether such is of a rectangular or square shape. For optimum performance, the ultrasonic transducer 96 should be centrally located within the base member. The transducer used in the practice of the invention (Model AF-618-12) as above-mentioned, measures about 6" wide, about 18" long, and is about 3¼" deep. The base member used in the practice of the invention is of a rectangular shape, about 32" in length, about 12½" wide and 7½" in height. Thus, with the transducer centrally disposed, as preferred, the sides and ends of the transducer will be surrounded by cleaning liquid. Such is desirable to prevent the transducer from overheating during operation. Further, more uniform cavitation is believed to result from such a location, as the output of the transducer is from the top planar surface thereof The transducer elements (not shown in the drawings) are provided in a linear array extending lengthwise of the transducer 96 which itself extends lengthwise of the base member 12. The transducer 96 because of its linear configuration and location in the base member provides a radiation pattern that is primarily in an upward direction. As a result, the ultrasonic waves propagated by the transducer surrounds the elongated pendants from top to bottom providing good overall cleaning of the pendants. The cleaning of the pendants in situ and while the pendants are each disposed during cleaning vertically downwardly and spaced apart from one another precludes little, if any, shadowing from occurring during the ultrasonic cleaning of the pendants. Although the transducer disclosed heretofore, and its centrally disposed location, has been found quite satisfactory in the practice of the invention, it will be appreciated that a transducer with more or fewer elements may be found to provide more optimum cleaning with a base and top member of different size and configuration. Also, a transducer having different elements therein or of a square shape may be found more satisfactory where the base member is a square or the length of the base member is closer to the width dimension. Various transducers for the purposes intended herein are commercially available. The selection of the most optimum transducer for the most optimum size base and top members, and for the efficient cleaning of the chandelier pendants is believed to be well within the skill of those in the art.

In use of the ultrasonic cleaning apparatus 10, the ultrasonic cleaning apparatus is first positioned on a staging so that the support member 14 is located below the chandelier to be cleaned. This can readily be accomplished by hand. The distance the cleaning apparatus is located initially below the chandelier can vary somewhat depending to a large extent upon the particular configuration of the chandelier, e.g., whether the chandelier comprises pendants located in tiers. The main consideration is that the top end of the top member of the cleaning apparatus be clear of the bottom ends of the pendants when the cleaning apparatus is first positioned. The cleaning apparatus is then raised to its operative position with the plurality of pendants first selected to be cleaned each being suspended vertically downwardly in the cavity of the top member 42. Any more precise registration of the top member with the chandelier and the plurality of pendants preselected for cleaning can be made at this time. Desirably the aligned pendants will be located equidistantly from the side walls of the top member. This will better ensure that the downwardly suspended pendants are each subjected to uniform cleaning on the entire surface exposed to the cleaning liquid.

The cleaning apparatus 10 should be raised vertically to a sufficient level that the entire length of each of the pendants selected to be cleaned is located within the cavity of the top member. Thus, when the cleaning liquid, i.e., tap water, is added to the cleaning apparatus, the top ends of each of the pendants to be cleaned will be, and this is of critical importance, submerged in the cleaning liquid and below the liquid level about an inch or so. This will ensure that the entire length of the pendants are subjected to the ultrasonic cleaning.

The ultrasonic cleaning apparatus of the invention can be raised to, supported in the raised position, and lowered from the operating position by means of a conventional portable jack or scissors lift commonly used in car repair shops, if desired. In the use of such a lifting means, a lift mounting plate such as referred to by reference numeral 116 (FIG. 4) is fixedly secured to the bottom of the ultrasonic cleaning apparatus or to a platform or support therefor, such as disclosed in FIG. 4. The mounting plate 116 is provided with a tubular-shaped, elongated member 118 that extends vertically downwardly from the center of the mounting plate and is fixedly secured to that plate by conventional techniques, e.g. welding. The member 118 is detachably connected in male and female manner to a member located on the lifting means. It is important that such connecting members (not shown) provide that the side walls of the cleaning apparatus are vertically upright so that the pendants will be free of the inner surfaces of the walls during the cleaning operation. This can be readily accomplished by those skilled in the art. The connection, most preferably, should also provide that the cleaning apparatus is rotable with respect to the lifting means. Nevertheless the elongated member 118 can, if desired, be a rod having an external thread pattern mating with a member having an internal thread pattern provided on the lifting means for detachably connecting the cleaning apparatus to the lifting means.

Figure 5:
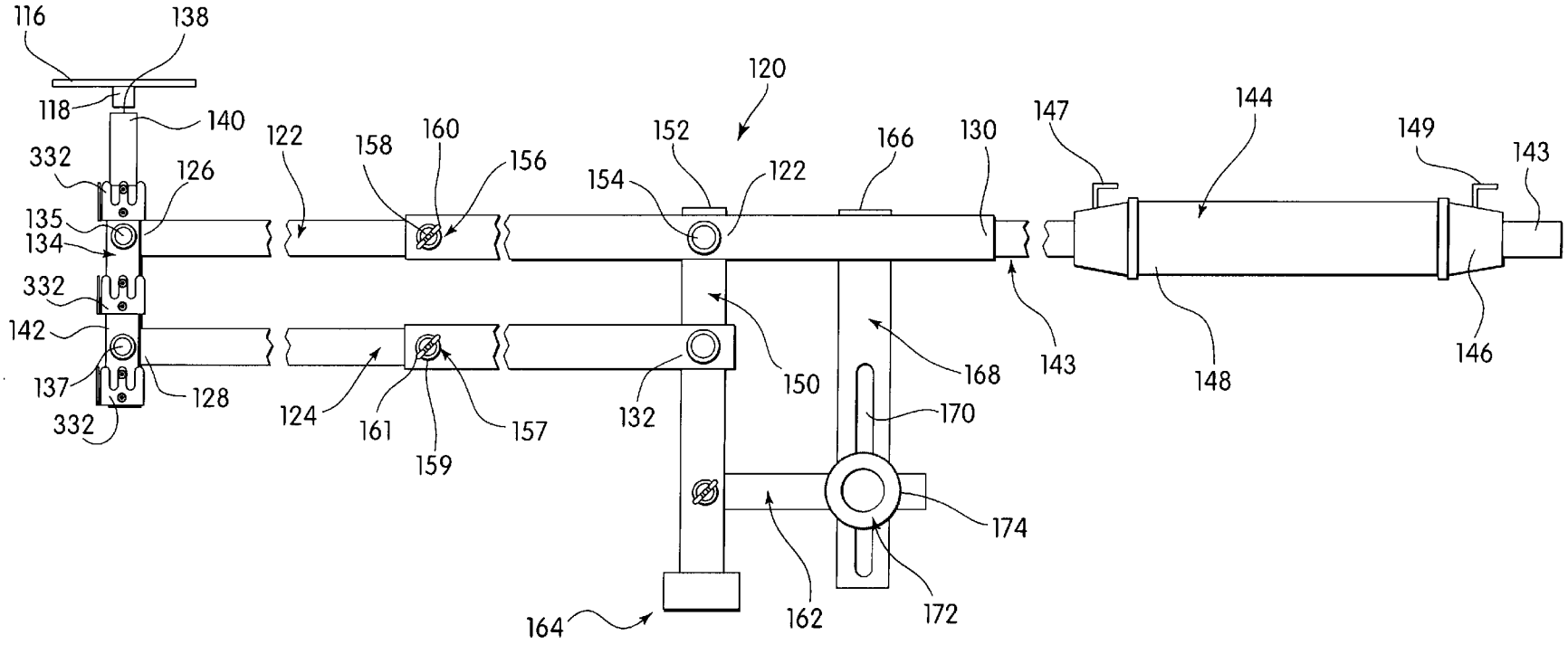
FIG. 5 is a view in perspective showing one embodiment of lifting means according to the invention for the raising and lowering of ultrasonic cleaning apparatus of the invention and for the maintaining of the cleaning apparatus in the raised position during the cleaning operation.

There is shown in FIG. 5 apparatus or means 120, according to another aspect of my invention, that is particularly useful in the raising, supporting, and lowering of cleaning apparatus of the invention, particularly that as shown in FIGS. 1, 2. As shown in FIG. 5, the apparatus 120 comprises in its basic aspects a parallel linkage comprising top and bottom members 122, 124 spaced apart from one another in the same vertical plane and in parallel disposition to one another. The top and bottom members 122, 124 are defined by distal ends 126, 128 and proximal ends 130, 132, respectively. The distal ends of the top and bottom members are pivotably connected at locations 135, 137 to a first vertically upright member 134 at the bottom end thereof, as shown in the drawing.

At the top end 138 of the vertically upright member 134, there is detachably connected a horizontally disposed mounting plate 116, earlier disclosed. Nevertheless, those skilled in the art will understand that such a mounting plate or support member for the ultrasonic cleaning apparatus can take various forms and configurations. This mounting plate or support member functions to support the ultrasonic cleaning apparatus, e.g., the cleaning apparatus such as is shown in FIGS. 1, 2, while it is being raised into operative position with the pendants to be cleaned, while the cleaning operation is being performed, and while the apparatus is being lowered and repositioned to clean a further group of pendants. The cleaning apparatus, importantly, is supported so that the side walls of the ultrasonic cleaning apparatus are maintained in vertically upright manner. This is important to provide the correct registration between the pendants and the cleaning apparatus so that no part of the pendant surfaces contact the side wall surfaces during the cleaning operation, possibly resulting in such surfaces receiving less exposure to the ultrasonic cleaning action than those surfaces not in contact. The mounting plate 116 can be provided with a downwardly extending member 118 provided with an external thread pattern (not shown) that mates with an internal thread pattern (not shown) provided in the top end 138 of the upright member 134. The top portion 140 of the upright member 134 can be rotatable in the bottom member 142 thereof, if desired. Also, if desired, the top portion of the upright member 134 can be provided in telescoping manner in the bottom portion.

As shown in FIG. 5, the elongated top member 122 is critically somewhat longer than the elongated bottom member 124, the reason for which will soon be made clear. Connected to the proximal end of the top member 122 is an elongated extension member 142 on which is provided an adjustable counterweight 144. The purpose of the counterweight 144 is, of course, to provide a weight that balances the weight of the ultrasonic cleaning apparatus during use, providing greater ease not only in the raising and lowering of this apparatus upwardly and downwardly but also in maintaining the cleaning apparatus in the desired elevated location during the entire cleaning operation.

The counterweight 144 comprises an annular-shaped hub member 146 having a circular-shaped opening of a slightly larger diameter than the diameter of the extension member 142 so as to be slidable along its length, as desired. The counterweight 144 further comprises a weight member 148 integral with the hub member and having a predetermined weight the same as that of the cleaning apparatus filled with water or not, as desired. Where the counterweight is the weight of the unfilled cleaning apparatus, the counterweight will need be moved a short distance along the length of the extension member when the apparatus is filled to provide the optimum balance. The location of the counterweight on the extension member can be maintained at a desired point by a set screw member 148 in usual manner.

The proximal end 132 of bottom member 124 is pivotably connected to a second vertically upright member 150 adjacent the bottom end of that member, as shown in the drawing. The top end 152 of the vertically upright member 150 is pivotably connected to the elongated top member 122 at a point 154 located between the proximal and distal ends thereof, as shown. The exact location of this pivotal connection along the top member 122 will depend to some extent upon just how much leverage is desired to be provided by the counterweight 144. In general, the closer that the second vertically upright member 150 is provided to the first vertically upright member 134, the greater will be the leverage that can be provided by the counterweight 144 relative to the weight of the cleaning apparatus. Thus, if a greater or lesser amount of leverage is desired to be provided by the counterweight for any particular location of the top end 152 of the member 150 between the proximal and distal ends of the top member 122, one need merely move the counterweight 144 backward or forward along the length of the extension member 143. In any event, the location of the top end of the second vertically upright member must be such as to maintain the parallel relationship of the top and bottom members and the first and second vertically upright members 134, 152. At rest, or in the neutral position, these four members will form a rectangle. When the apparatus is operated to raise and lower the ultrasonic cleaning apparatus, the top and bottom members will always remain parallel to one another, as will the first and second vertically upright members.

The top and bottom members can each be of tubular shape as shown in FIG. 5; however, this need not necessarily be the case. These members can be of rod stock, if desired, as also can the extension member 142. Where the top and bottom members 122, 124 are of tubular shape, each member will comprise two parts, the one part having an outer diameter somewhat smaller than the inner diameter of the other so as to allow the one part to telescope into the larger diameter tubular part. Thus, the raising and lowering means 120 has greater application as it can be readily adjusted in length to provide the desired leverage in any particular case merely by telescoping the parts of the two members together to a greater or lesser extent. Perhaps of more importance, however, is that the upper and lower members can be extended easily to a greater length in any particular cleaning operation so as to provide greater access to pendants that are to be cleaned. The outer and inner diameters of the telescoping parts should not, however, be so great as to allow a lot of relative movement or free play between the two parts. The telescoping parts should desirably be merely free sliding one within the other. It is not necessary that both the top and bottom members be provide of two parts, each of tubular construction for purposes of providing that one part be capable of telescoping into the other. One part of a member, if desired, can be a tube and the other a rod.

The two parts making up the top and bottom members are each provided with a plurality of pairs of opposed openings (only one pair being shown in the drawing for sake of clarity( such as referred to in FIG. 5 by reference numerals 156, 157. In providing a top and bottom member of the desired length, the two parts making up a member are either pulled apart or pushed together so as to line up the pairs of openings provided in the telescoping parts. Then, elongated pins 158, 159, conventionally known, with a head on one end and an opening on the other is inserted through the openings in usual fashion. A keeper 160, 161 then is inserted through the pin openings to prevent accidental dislodgment of the pin and to maintain the two parts in fixed location relative to one another.

At the bottom end of the vertically upright member 150, there is provided an elongated member 162 one end of which is fixedly secured to upright member 150, the bottom end of which is located in a collar 164. The other end of the elongated member 162 is provided with a bore (not shown), in which is provided an internal thread pattern (not shown) according to usual technique. Extending vertically downwardly from, and pivotably connected to the top member 122 at its top end 166 is a third vertically upright member 168. This member is parallel to the upright member 150 and is always in such a position whether the lifting means is in the home or raised position. The bottom end of the upright member 168 is provided with an elongated slot 170 in which is located the elongated shaft (not shown in the drawing) of fastening member 174. This shaft is provided along its length with a thread pattern complementary to that provided in the bore 166 in the member 162. Thus, the shaft 172 can pass through the elongated slot and the end thereof be threadably connected to the elongated member 162. The opposite end of the fastening member 174 is provided with a knurled knob 172 in usual fashion to aid in the turning of the fastening member.

In use of the lifting means 120, the fastening member 174 is loosened so that the ultrasonic cleaning apparatus, e.g., apparatus such as is shown in FIG. 1 of the drawing (the apparatus already having been mounted to support plate 116) can be raised vertically upwardly to the height desired. Then, the fastening member is threaded into the threaded bore so as to maintain the top and bottom members 122, 124 in their raised positions and to maintain the ultrasonic cleaning apparatus in the raised position during the cleaning of the pendants to be cleaned. Importantly, the ultrasonic cleaning apparatus is provided in level manner with respect to the means supporting it. This is desired so that the pendants being cleaned do not touch the inside of the side and end walls of the apparatus.

When the ultrasonic cleaning of the selected grouping of pendants of the chandelier has been accomplished, the fastening member 174 is loosened so that the cleaning apparatus can be lowered vertically downwardly. On reaching the home position, i.e., the top and bottom members are located in horizontally disposed planes, the fastening member is then turned so as to locate the elongated member 162 at the desired location in the slot 170. The cleaning apparatus, still attached to the lifting means, can then be moved to a new location for cleaning of another selected group of pendants.

Although not shown in FIG. 5 of the drawing, there is provided in the bottom end of the collar 164 and extending inwardly therefrom a dead bore, such being provided with a thread pattern, the purpose for which will be soon disclosed. An elongated vertically disposed member (not shown) having an external thread pattern at the top end for engagement with the collar 164 and a suitable standard at the other end can be provided for the holding of the lifting means at some desired elevation. This standard can be adjustable to provide the lifting means at different elevations, as desired. More preferably, however, the collar 164 is detachably connected to a conventional jack means, e.g., so-called scissors jack, provided with rollers whereby the cleaning apparatus can be readily moved about. The collar 164 can be provided so as to be rotatable on the vertically disposed member, if desired. This can be accomplished by various means well known to those skilled in the art. Thus, the scissors jack can be used for first elevating the ultrasonic cleaning apparatus and more precise elevation, holding the cleaning apparatus in position during the cleaning operation, and lowering it to the home position can be accomplished by using the lifting or elevation means 120 of the invention.

The cleaning apparatus of FIG. 1 has been specifically disclosed with respect to the cleaning of chandeliers comprising downwardly extending pendants and wherein the pendants are arranged in parallel rows and columns of pendants. Nevertheless, in some chandeliers the downwardly extending pendants are provided in a plurality of concentric circles. In this case, a top member having a wide top end such as disclosed in FIG. 2 can, in some cases, be used; however, this is somewhat impractical. A more preferred and practical ultrasonic cleaning apparatus for such chandeliers is shown in FIG. 6 of the drawing.

Figure 6:
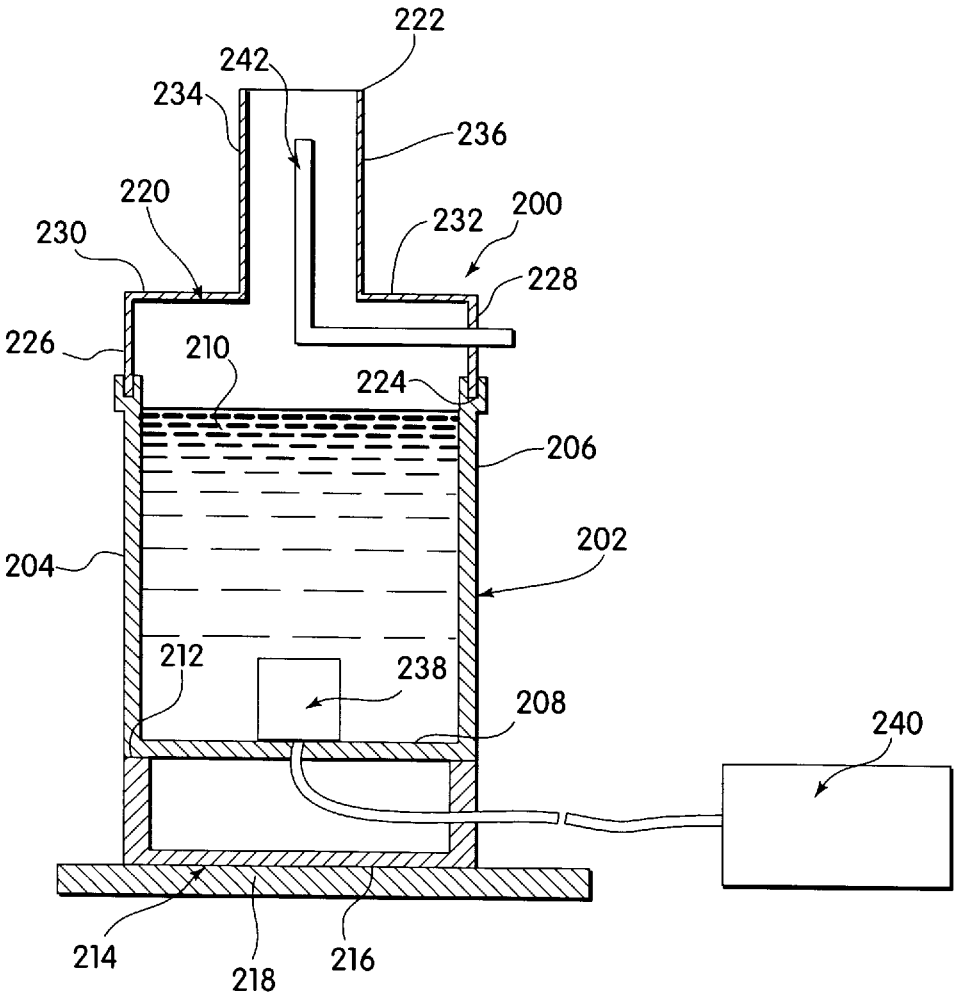
FIG. 6 is a view in cross-section of another embodiment of ultrasonic cleaning apparatus according to the invention for the cleaning of the pendants of a chandelier that are arranged in concentric circles.

Turning now to FIG. 6, there is shown therein ultrasonic cleaning apparatus 200 particularly suitable for the ultrasonic cleaning of both downwardly extending pendants arranged in concentric circles and festoons of beads. The apparatus 200 is defined by a bottom member 202 defined by vertically disposed spaced-apart and parallel side walls 204 and 206 and end walls not shown in the drawing. The bottom member is of a box-like construction having a horizontally disposed bottom closure 208 and an open top 210. The bottom member can be of rectangular or square cross-section, as desired. The bottom member 202 can be of much greater length than width, if the pendants of the chandelier to be cleaned are close together or the location of the chandelier makes such more practical. The bottom closure 208 is fixedly secured to the top end 212 of a support or base member 214. This can readily be accomplished by various known techniques. The bottom end 216 of the base member 214 is secured to a mounting plate or platform 218, the purpose for which will be disclosed hereinafter. Thus, the base member can be fixedly or detachably secured to the platform, as desired. This can readily be accomplished by those skilled in the art. The platform 218 can be connected to the elevation means 120 (FIG. 5) in a any suitable manner e.g., in a manner such as earlier disclosed. Nevertheless, this can be accomplished by various means well known to those skilled in the art.

Figure 7:
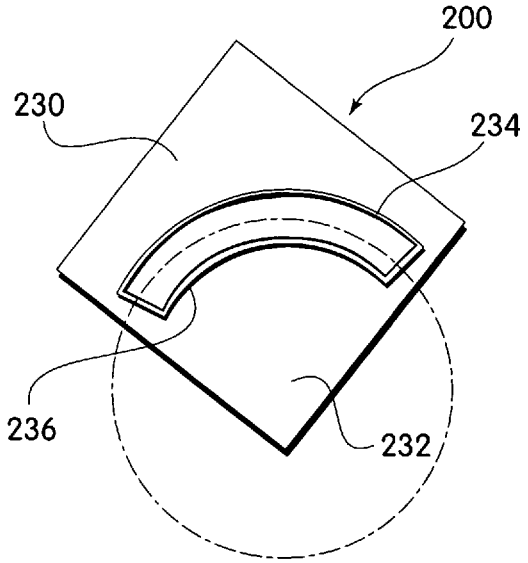
FIG. 7 is a top plan view of the top member of the ultrasonic cleaning apparatus shown in FIG. 6, better showing the arcuate shape of the top end of the top member.

As shown in FIG. 6, the ultrasonic cleaning apparatus 200 further comprises a top member 220 having an open top defined by a horizontally disposed top edge 222 and an open bottom defined by a horizontally disposed bottom edge 224. Thus, the top member 220 communicates with the bottom member 202 and defines a cavity for the holding of cleaning liquid, as earlier disclosed. The top member 220 is defined by vertically upright, spaced-apart, side walls 226 and 228 in parallel relationship to one another and vertically disposed, parallel end walls, not shown in the drawing. The horizontally disposed edge defined by the open top 210 of bottom member or housing 202 is provided with a U-shaped channel as earlier disclosed with respect to the cleaning apparatus 10 of FIG. 1 and for the same purpose. Thus, the bottom edge of the top member and the top edge of the bottom member are provided in sealed engagement with one another so that no cleaning liquid can escape when the two members are connected together. This can readily be accomplished by those skilled in the art. This sealed engagement is of critical significance so that the top and bottom members will function as if it were a unitary structure, though having interchangeable top members. The top and bottom members can be provided with fastening means, e.g., like that for the cleaning apparatus of FIG. 1, so that the top and bottom members can be drawn together and maintained in liquid sealing engagement, during use of the cleaning apparatus. The side walls 226 and 228 terminate at the upper edges thereof being connected, respectively, to the outer edges of horizontally disposed upper members 230 and 232. These upper members, as shown by FIG. 6, lie in the same horizontal plane and terminate at their inner edges, respectively, at the bottom edges of side walls 234 and 236. The top edges of these last-mentioned side walls define the open top edge 222 of the top member. Although the side walls 226 and 228 of the top member define a bottom edge that is rectangular in shape, the side walls 234 and 236 can be of an arcuate shape, if desired. Thus, the side walls 234 and 236 can be defined by segments of circles that are concentric, as shown in FIG. 7, if desired. This arcuate configuration is particularly useful in the cleaning of downwardly extending concentric circles of elongated pendants or swags or festoons of beads, later more fully disclosed.

Located in the bottom member 202 and secured to the top surface of the bottom closure 208 is an ultrasonic transducer 238 connected to a generator 240 according to usual technique. The particular transducer used, as earlier disclosed, will depend to a large extent upon the size of the cleaning apparatus, i.e., the volume of cleaning liquid the apparatus is to hold. The generator is, of course, connected to a conventional source of electricity (not shown). Various ultrasonic transducers can be selected to accomplish the purposes of this invention.

The apparatus of FIG. 6 is most preferably of a compact design making it particularly suitable for getting into tight places, where the spacing between pendants is close, e.g. only 1–3 inches apart, and for the cleaning of swags and pendants located in circular rings concentric to one another. Nevertheless, it will be appreciated by those skilled in the art that the dimensions of the top and bottom members can vary, as also can the radius of the arcuate top member. This will depend in large part on the configuration of the chandelier to be cleaned. In general, however, such apparatus can be constructed having a cavity for the cleaning liquid measuring about 3"×3"×6" in which case the apparatus will hold about 3¾ cups of water. A suitable transducer for such apparatus is commercially available from Branson (Stock No. 999-999, 2"×2", output 40 khz). It will be appreciated by those skilled in the art, however, that the measurements may be changed somewhat, depending upon the measurements of the top member, but still containing about the same volume of cleaning liquid and obtaining the same good cleaning results.

The arcuate-shaped part of the top member can be manufactured separately from the bottom part thereof and the two parts then fixedly secured together by, e.g., welding or other techniques well known to those skilled in the art. A number of such arcuate-shaped top members will need be provided, depending upon the different sizes of chandeliers to be encountered Although a number of arcuate-shaped top members of different radii will need be provided to accommodate chandeliers having circles of pendants of different radii, the top members can be interchangeable with one another and fit to a common body member. Quite advantageously, however, ultrasonic cleaning apparatus having the appropriate arcuate configuration for a particular chandelier comprising concentric circles of pendants will be found suitable for the cleaning of pendants in that particular chandelier located in any of the concentric circles making up the chandelier. In the most preferred top member for the ultrasonic cleaning apparatus shown in FIG. 6, the arcuate shape of the top member in each case will be determined by a concentric circle of pendants having a radius that is midway between that defining the side walls 234, 236. Thus, the circle of pendants will be located midway between the sidewalls and out of contact with the walls of the cleaning apparatus, better ensuring that the pendants receive the full benefit of the ultrasonic cavitations.

As shown in FIG. 6, the ultrasonic cleaning apparatus 200 can be, if desired, provided with an overflow pipe 242 having a vertically disposed member and a horizontally disposed member, these two members being joined together at right angles, as shown in the drawing, to provide a unitary overflow pipe. The latter member, as will be seen from the drawing, extends outwardly from the side wall 226 of the top member, the free end of which is connected to a discharge collector (not shown). The vertically disposed member of the overflow pipe terminates in an open top end located in a predetermined horizontal plane to maintain the desired level of water in the cleaning apparatus. Thus, when the apparatus is being filled with the cleaning liquid, the operator will know when the desired level has been reached as such will overflow and pass out through the overflow pipe. At that time the water to the ultrasonic cleaning apparatus can be shut off. Nevertheless, it is not essential that such an overflow pipe be provided in the apparatus disclosed in FIG. 6. The level of the water is preferably determined, at least in some cases, by providing a scale, later more fully disclosed, on the inside surface of one of the side wall members 234 236, the scale extending downwardly from the top edge 222.

Figure 8:
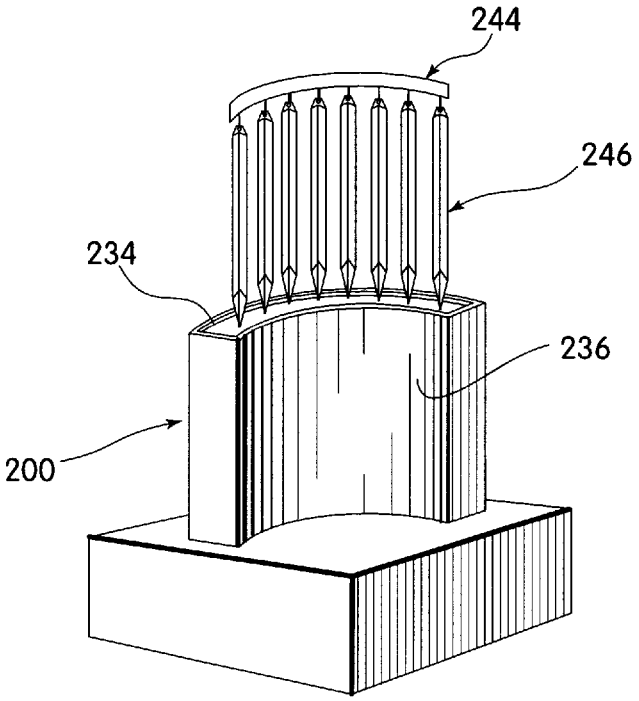
FIG. 8 is a view in perspective showing the apparatus of FIG. 7 being used for the ultrasonic cleaning of a chandelier comprising a plurality of downwardly extending elongated pendants arranged in a plurality of concentric circles.

Turning now to FIG. 8 of the drawing, the cleaning apparatus 200 is shown being used in the cleaning of a chandelier 244 (only a part of which is shown) comprising a plurality of downwardly extending elongated pendants 246, arranged in concentric circles. Of great advantage is the fact that the pendants can be cleaned in situ The pendants of the chandelier 244 are seen to terminate in the same horizontal plane, rather than being provide in tiers, as earlier disclosed. The cleaning apparatus 200 is first provided on staging (not shown) located below the chandelier 244. The apparatus 200 is supported by elevation means 120 such as shown in FIG. 5, but not shown in FIG. 8 of the drawing, the elevation means being supported by a scissors jack as earlier disclosed (also not shown in FIG. 8). The cleaning apparatus shown in FIG. 8 is then raised vertically upwardly and is supported in that raised position, as earlier disclosed using elevation means 120 (not shown) just below the pendants of the chandelier to be cleaned as shown in FIG. 8. The cleaning liquid is then added to the apparatus 200 through inlet means (not shown), the water level being allowed to rise until water flows out from the overflow pipe, or the desired level is shown by the scale provided. At that time the water is shut off. The cleaning apparatus is then further raised vertically upwardly so that the top ends of the pendants are fully immersed. The apparatus is then supported in that position until the ultrasonic cleaning has been accomplished. Following the filling of the cleaning tank with water, and ensuring the pendants are fully immersed, the ultrasonic transducer is activated, to provide the desired cavitation for the cleaning operation and the pendants selected are cleaned. The apparatus is then lowered to clear the bottom of the pendants just cleaned and repositioned for the cleaning of the next selected group of pendants. The ultrasonic cleaning apparatus is again raised, the next group of pendants to be cleaned are immersed and these pendants are ultrasonically cleaned. The cleaning apparatus is then lowered and the apparatus repositioned for the cleaning of the next selected pendants. This procedure continues until the pendants of the chandelier are all cleaned.

Figure 9:
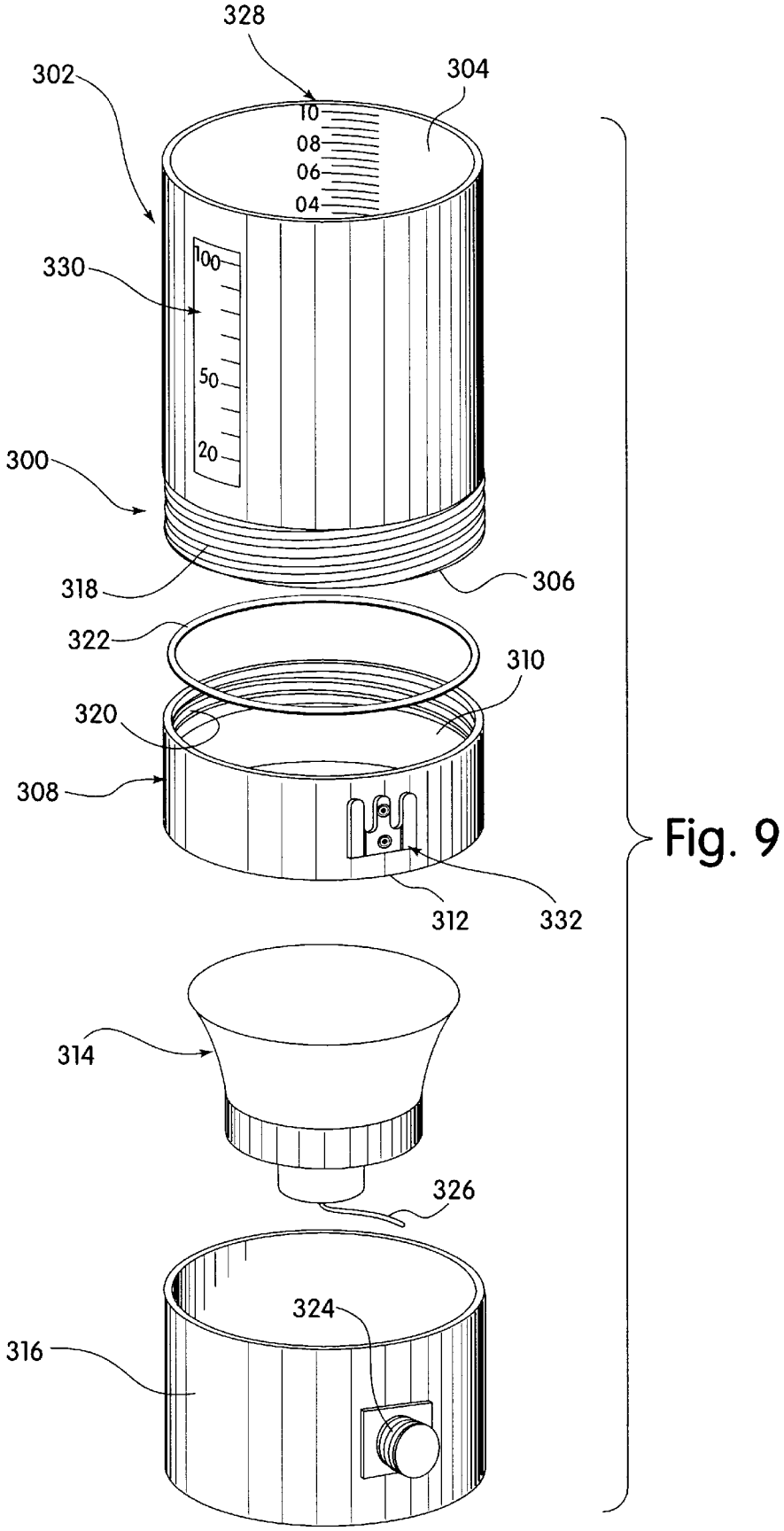
FIG. 9 is an exploded view in perspective showing a further embodiment of ultrasonic cleaning apparatus according to the invention, such apparatus being fully portable and capable of being hand held during use.

Referring now to FIG. 9 of the drawing, there is shown therein a further embodiment 300 of ultrasonic cleaning apparatus according to the invention for the cleaning of a chandelier. The ultrasonic cleaning apparatus 300 comprises a top member 302 having open top and bottom ends 304 and 306, and a bottom member 308 detachably connected to the top member. The bottom member 308 is defined by an open top end 310 and a closed bottom end 312. Fixedly secured to the bottom end 312 is an ultrasonic transducer 314. Surrounding the transducer there is provided a cover or housing 316 for protecting the transducer.

On the top member, at the bottom end thereof, there is provided an external thread pattern 318. This thread pattern is complementary to the internal thread pattern 320 provided on the top end of the bottom member 308. Thus, the top and bottom members of the ultrasonic cleaning apparatus 300 can be detachably connected together. The top and bottom members are provided in sealed engagement by means of a gasket 322, according to usual techniques.

In the wall of the housing 316, there is provided a conventional connector 324 to which is connected the cable 326 from the ultrasonic transducer 314. The connector 324 is connected in usual fashion to a generator (not shown) which, in turn, is connected to a source of electricity, e.g. the conventional wall plug. Various transducers will be found suitable for use in the ultrasonic cleaning apparatus 300, the main requirement being that sufficient cavitation be produced in the cleaning liquid, i.e., tap water, used in the cleaning operation to provide the desired cavitation for the proper cleaning action. This will depend mostly upon the size of the apparatus being used and the volume of cleaning liquid. The selection of a transducer providing optimum performance can readily be done by those skilled in the art. Where the apparatus is of the configuration shown in FIG. 9, i.e. of tubular-shape, a cavity for the cleaning liquid measuring about 2½"× about 4½" will be found quite suitable. Such a cavity will contain about 1¾ cups of water. Adequate cavitation will be produced using the same Branson 2"×2" transducer (Stock No. 999-999) earlier disclosed.

The top member 302 is provided on its inside surface with a scale 328 divided into suitable gradations, as shown, e.g., ⅛ inch gradations. Thus, a standard can be set so that an operator knows just how high to fill the cleaning apparatus with water before immersing one or more of the elongated pendant or festoons of beads, as hereinafter made more clear, therein to prevent overflow of the cleaning solution. This is an important consideration in view of the fact that the ultrasonic cleaning apparatus 300 is of a size that can be hand-held during use and is not provided with means to catch cleaning liquid that might overflow the top end of the top member. Optionally, the ultrasonic cleaning apparatus of the invention, as disclosed in FIG. 9, can be provided with an overflow pan or plate (not shown). Thus, in the ultrasonic cleaning apparatus shown in that FIG. 9 of the drawing, an overflow plate in the shape of an inverted saucer can be provided. This can be located between the cap or top member and the bottom member, just below the sealing gasket shown. The overflow plate will need be, of course, provided with a suitable cut-out of the same diameter as the top open end of the bottom member to allow for communication between the cavities in the top and bottom members. The overflow plate need not be of a saucer-shape, instead, it can be of box-like configuration with an open to end and a closed bottom end, if desired, taking into consideration the need for the cut-out in the bottom end. Nevertheless, whatever the shape, the overflow plate need be sufficiently greater in size than the size of the top and bottom members to catch and hold the overflowing cleaning liquid, if any. In general, the shape of the overflow plate will be determined to some extent by the shape of the ultrasonic cleaning apparatus. For example, if the cleaning apparatus is of circular shape, the saucer configuration may be found more suitable.

On the outside surface of the top member 302, there is, most preferably, provided a thermometer or temperature gauge 330. Thus, during use of the ultrasonic cleaning apparatus 300, the operator can be aware at any point in time of the temperature of the water being used as the cleaning solution. In general, the transducer works better with hotter water, rather than colder water. Thus, in the practice of the invention, I have found that best cleaning occurs at a water temperature of from about 105° F. to about 130° F., preferably at least about 120 degrees F. When the water temperature falls much below 120° F. and certainly below a temperature of 105°, the water in the ultrasonic cleaning apparatus should be discarded and the cleaning apparatus filled with a new supply of hot water.

In the case of hand-held ultrasonic cleaning apparatus such as shown in FIG. 9, the length of the top and bottom members combined may be only from about 6–10 inches and the diameter only from about 3–6 inches. Nevertheless, the cleaning apparatus can be of any length and diameter desired. This will be determined to some extent by the various configurations of chandeliers to be cleaned. The top member can even be, if desired, of a size that only one pendant or festoon of beads is cleaned at one time. Of great advantage in the practice of the invention is that a bottom member of one size and configuration can be used as a standard and used with a wide number of top members of different sizes and configurations. For example, the top member may be of rectangular shape and the bottom member of tubular shape. The two members can be detachably joined for example, by providing a circular-shaped collar or tubular member on the bottom of the top member. Such a collar can be fixedly secured to the bottom of the top member, by various means known to those skilled in the art, e.g., by welding or with adhesives capable of providing a strong bond between two metals, e.g., the epoxy resin adhesive. The collar will be provided with a thread pattern at the bottom free end thereof for connection with the threaded top end of the bottom member as shown in FIG. 9. Naturally, there will be an opening in the bottom of the top member and of the same diameter as the collar for providing communication between the cavities in the top and bottom members. Instead of being of a rectangular shape, or circular as shown in FIG. 9, the top member can be of square shape, if desired, to accommodate the cleaning of pendants or festoons of beads making up the chandelier. The top end of the top member in some cases can even be of arcuate shape, e.g., for the cleaning of chandeliers having concentric circles of pendants or festoons of beads.

On the outside surface of the base member 308, there is provided means referred to generally by reference numeral 332 for detachably connecting a handle, later made fully described, to the cleaning apparatus 300 whereby the apparatus can be hand-held during use. Such a means can take various forms known to those skilled in the art; however, the conventional bayonet- or mirror-type fastening means will be found quite satisfactory for this purpose. Thus, one portion of the bayonet fastener 332 is provided on the bottom member and the other portion on the handle. Nevertheless, if desired, a handle can be fixedly secured to the bottom member. Although a fastener is shown to be provided only on the bottom member, those skilled in the art will readily appreciate that such a fastener can be provided on the top member, instead, if desired, or such fastening means may be provided, in some cases, on both the top and bottom members.

It will be seen by reference to FIG. 5, that complementary fastening means, like those referred to by reference numeral 332, can be provided on the upright member 334 of the elevation means 120. Thus, where an ultrasonic cleaning apparatus such as shown in FIG. 9 cannot readily be held by hand due to the length or size of the cleaning apparatus to accommodate the cleaning of the pendants of a particular chandelier, or the cleaning apparatus cannot be comfortably be held by hand for extended periods of time in the cleaning of a chandelier having a very large number of pendants, e. g. thousands, the elevation means 120 shown in FIG. 5 can advantageously be used.

The top member 302 and housing 324 can be provided of aluminum or, if desired, of a plastic such as polypropylene. Where of aluminum the top member and housing are desirably painted or anodized. Nevertheless, the bottom member is importantly of stainless steel, e.g. 14–16 gauge, rather than of aluminum as the transducer will cause undue pitting of aluminum, necessitating frequent replacement of the bottom member. This is undesirable as the transducer is bonded to the bottom end of the bottom member.

Figure 10:
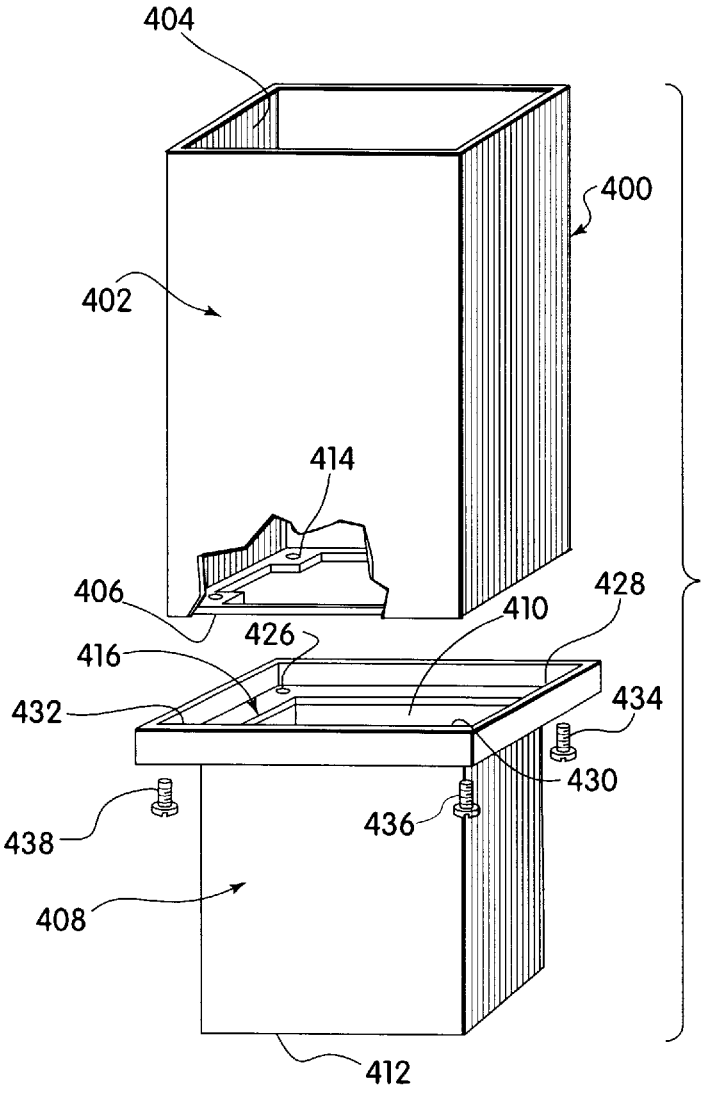
FIG. 10 is a perspective exploded view showing another ultrasonic cleaning apparatus according to my invention for the cleaning of the pendants of a chandelier.
Figure 11:
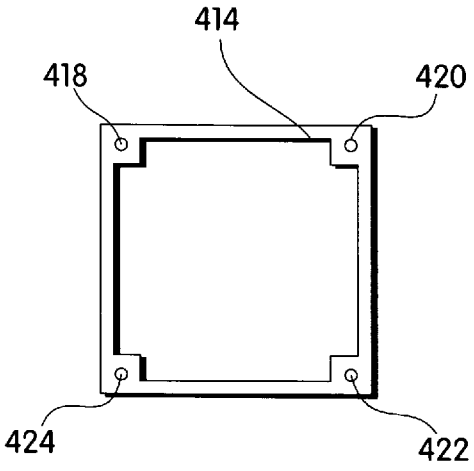
FIG. 11 is a bottom plan view of the bottom end of the top member of the cleaning apparatus shown in FIG. 10.

Turning now to FIG. 10, there is shown therein still another embodiment of ultrasonic cleaning apparatus according to the invention. The cleaning apparatus 400, as shown in FIG. 10, comprises a top member 402 having top and bottom open ends 404 and 406, respectively, and a bottom member 408, the same as do the embodiments of the invention disclosed earlier. The bottom member 408 is defined by an open top end 410 and a closed bottom end 412. Thus, there is provided a cavity in the top end that communicates with a cavity in the bottom end of the cleaning apparatus. At the bottom end of the top member there is provides a flange 414 which sits upon and is supported the flange 416 provided at the top end of the bottom member. In the flange 414, there are provided threaded openings 418, 420, 422, and 424. These openings are in direct opposition to the openings 426, 428, 430, and 432, respectively, provided in the flange 416. Through these latter openings pass threaded members 434, 436, and 438. It will, of course, be appreciated that a like threaded member (not shown) is provided for the opening 426. Thus, the top and bottom members can be provided in detachable connection with one another. Although not shown in the drawings, there will be provided a suitable gasket to provide a good seal at the connection of the two members. A transducer (not shown) is provided in the bottom member, Thus, the bottom member, in this case, will serve as a housing for the transducer, the bottom surface of the transducer being fixedly connected to the inside surface of the bottom end of the bottom member. Nevertheless, in some cases, the ultrasonic transducer is attached directly to the bottom of the top member thereby serving as a closure and the bottom member merely being a protective housing for the transducer. With such apparatus, a cavity measuring about 3"×3"×6" and holding about 3¾ cups of water will be found to produce good results. The ultrasonic transducer used in this apparatus is preferably the same as that earlier disclosed.

Figure 12:
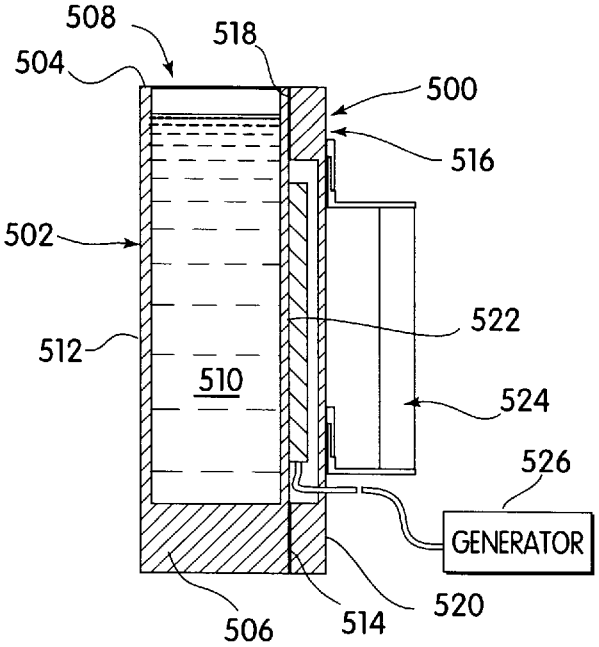
FIG. 12 is a view in cross-section showing still other ultrasonic cleaning apparatus according to my invention for the cleaning of chandeliers.

In FIG. 12, there is shown still another embodiment of ultrasonic cleaning apparatus 500 according to the invention. This apparatus comprises a body member 502 having an open top 504 end and a closed bottom end 506. Thus, there is provided a cavity 508 for location of water or other cleaning solution for the cleaning of the pendants or festoons of a chandelier, as later more fully disclosed. The body member 502 is further defined by parallel side walls 512 and 514. Attached to the side wall 514, as shown in the drawing is a vertically disposed cover member or housing 516 having a planar inner face 518 and a parallel planar outer face 520. The cover is, desirably, detachably connected at it inner face 518 to the side wall 514 of the body member. Located inside the housing is a so-called "pancake" or "sandwich" transducer 522 known to those skilled in the art. Such a transducer is of light weight and thin and comes in various sizes, e.g., 2", 3", and 6" diameters. Accordingly, a very compact cleaning apparatus is provided. The face of the transducer is fixedly secured to the side wall 514 of the body member. The transducer is connected to a 526 generator in usual manner which, in turn, is connected to a source of electricity (not shown). Thus, the sonic waves radiate from the transducer in mostly horizontal manner toward the immersed pendants or beads being cleaned rather than in a vertical manner, as in the other embodiments of the invention disclosed heretofore. The body member in this ultrasonic cleaning apparatus should be of stainless steel to reduce the pitting by the action of the transducer.

To the outer surface of the cover 520 there is attached a handle 524 for hand holding of the ultrasonic cleaning apparatus 500. The handle can be fixedly connected to the cover, or detachably connected, as earlier disclosed. This cleaning apparatus, advantageously, is compact in design, of low weight, and quiet easy to handle and maneuver because of the use of the pancake transducer. Nevertheless, it will be found to provide a satisfactory cleaning of the chandeliers, particularly where shorter length pendants or festoons of beads are to be cleaned.

Figure 13:
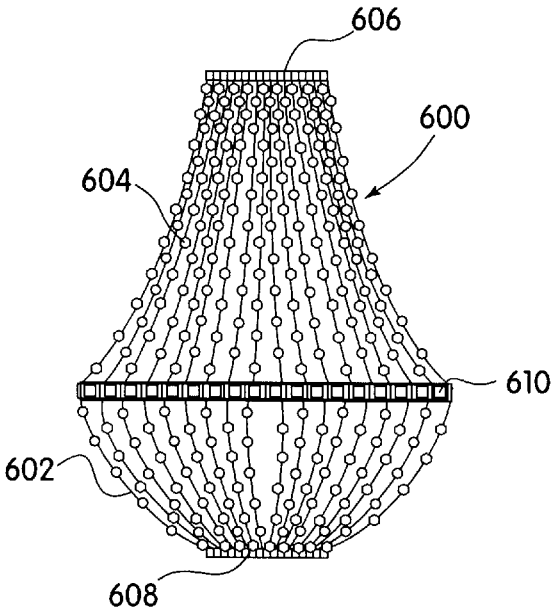
FIG. 13 is a perspective view showing a chandelier comprising a plurality of festoons of beads, rather than downwardly extending pendants.
Figure 14:
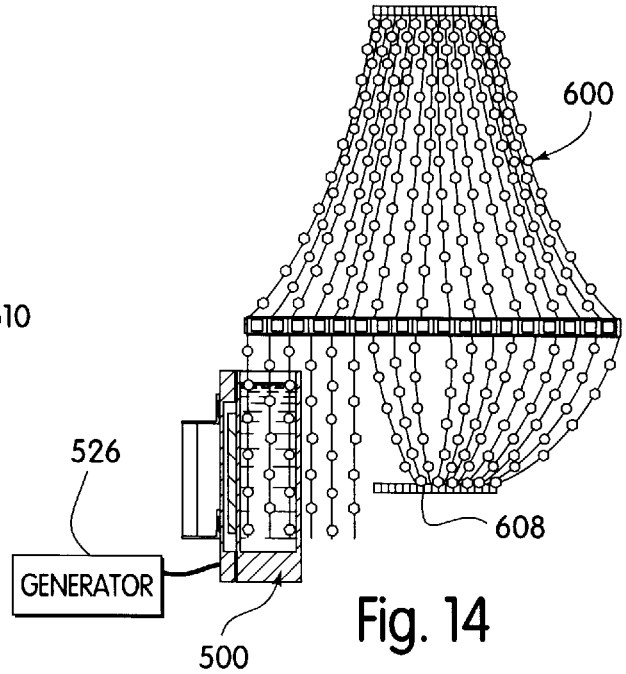
FIG. 14 is a view showing several of the festoons of the chandelier shown in FIG. 13 detached at their lower ends for the cleaning in situ with the ultrasonic cleaning apparatus shown in FIG. 13.

Turning now to FIG. 13, there is shown a chandelier 600 comprising a plurality of festoons 602, each comprising a plurality of beads 604. The festoons, in general, are connected at their top ends to a top mount 606 of circular shape. The bottom ends of the festoons are detachably connected to a bottom mount 608, also of circular shape. Intermediate the top and bottom mounts there is provided a circular ring 610 having cuts provided therein for maintaining the festoons in alignment from top to bottom and separated from one another. Several of the festoons, as shown in FIG. 14, are detached at their bottom ends for in situ ultrasonic cleaning of the beads and chains making up the festoons. The cleaning can be readily accomplished by the ultrasonic cleaning apparatus such as disclosed in FIG. 12. Apparatus having a cavity 4½"×2"×7½" will be found quite satisfactory in the cleaning of the festoons. Such a cavity will hold about 4½ cups of water. The "pancake" transducer is available commercially from Branson under the trade designation Vernitron 854 (pancake type) and has an output of 40 khz. Those skilled in the art, however, will readily appreciate that the festoons of the chandelier can be cleaned by any of the ultrasonic cleaning apparatus disclosed herein. And, moreover, apparatus such as disclosed in FIG. 12 can be used in the cleaning of pendants as well as festoons of beads. The size of the cavity, however, particularly the depth will be determined, in this case, by the length of the pendants to be cleaned.

Of great advantage, in the case of the hand-held apparatus is that a generator used with the transducer of very compact size. That makes it particularly suitable for portability, the same as is the cleaning apparatus. Thus, it will be found that, at least in some applications, the size of the ultrasonic generator is such that it can be carried on one's person, e.g., in a holster provided on a belt.

The side mounted transducer such as shown in FIG. 12 is not limited to that embodiment of the invention. The ultrasonic cleaning apparatus, for example, shown in FIGS. 9 and 10 can also advantageously be provided with side mounting of the transducer rather than mounting the transducer to the bottom member, at least in some applications. The side mounting of a transducer, quite advantageously, can save in the overall cost of the cleaning apparatus, as the bottom member is eliminated. It can also provide for greater portability.

Those skilled in the art will readily appreciate that the top and bottom members of the ultrasonic cleaning apparatus shown in FIGS. 6, 9, and 10 need not be detachably connected; however, this is most preferred as it will provide greater usefulness in the apparatus. Such detachability allows for a variety of top members of different sizes and configurations to be used with a bottom member of only one size and configuration. With the use of the compact ultrasonic cleaning apparatus of the invention, the power to the ultrasonic transducer can be left on continuously during the cleaning of a chandelier. Thus, the operator need not turn off the cleaning apparatus when moving from one group of, e.g., pendants, to be cleaned to another. This is believed advantageous as it appears to degas the water, providing for better cleaning.

The ultrasonic cleaning of the pendants or festoons of a chandelier using cleaning apparatus in accordance with the invention can be done whenever desired, i.e., when the chandeliers appears to need cleaning or on a set schedule, say every five or six months, to better maintain the attractiveness of the chandelier. Quite advantageously the apparatus of the invention offers economies that makes such cleaning of chandeliers more attractive than heretofore.

It will be understood that various changes in the details, materials, arrangement of parts, and operational conditions which have been herein described and illustrated in order to explain the nature of the invention and its operation may be made by those skilled in the art within the principals and scope of the invention.

Having thus set forth the nature of the invention, what is claimed is:

1. Process of cleaning a chandelier in situ comprising;

(a) providing a hand-holdable ultrasonic cleaning apparatus comprising:

(1) a body member defined by a top end and a bottom end, a closure being provided in said bottom end; said top end being open, a cavity being defined by said body member; and (2) an ultrasonic transducer, being provided in said cavity;

providing cleaning liquid in the cavity of said body member for the cleaning of a chandelier;

(c) raising said hand-holdable ultrasonic cleaning apparatus upwardly to said chandelier; and (d) cleaning said chandelier in situ.

2. Process of cleaning a chandelier according to claim 1 further comprising maintaining said cleaning liquid at a temperature of from about 105 degrees F. to about 130 degrees F.

3. Process of cleaning a chandelier according to claim 1 wherein said chandelier comprises a plurality of downwardly extending elongated pendants each defined by a top end and a bottom end and said cleaning process further comprises immersing the pendants in the cleaning liquid so that the top ends are covered by the cleaning liquid.

4. Process of cleaning a chandelier in situ comprising:

(a) providing a hand-holdable ultrasonic cleaning apparatus, a cavity being provided in said cleaning apparatus for holding a cleaning liquid for cleaning a chandelier;

(b) raising said cleaning apparatus upwardly to said chandelier; and (c) cleaning said chandelier in situ.

* * * * *